US011241124B2

(12) United States Patent
Keily et al.

(10) Patent No.: US 11,241,124 B2
(45) Date of Patent: Feb. 8, 2022

(54) DISPENSER WITH AUTOMATIC STUB ROLL DROP DOWN

(71) Applicant: Dispensing Dynamics International, Inc., City of Industry, CA (US)

(72) Inventors: Joel P. Keily, City of Industry, CA (US); Victor Landa, City of Industry, CA (US)

(73) Assignee: Dispensing Dynamics International, Inc., San Marcos, CA (US)

( * ) Notice: Subject to any disclaimer, the term of this patent is extended or adjusted under 35 U.S.C. 154(b) by 126 days.

(21) Appl. No.: 16/844,924

(22) Filed: Apr. 9, 2020

(65) Prior Publication Data

US 2020/0323401 A1 Oct. 15, 2020

Related U.S. Application Data

(60) Provisional application No. 62/833,271, filed on Apr. 12, 2019.

(51) Int. Cl.
*A47K 10/38* (2006.01)
*A47K 10/36* (2006.01)

(52) U.S. Cl.
CPC ..... *A47K 10/3836* (2013.01); *A47K 10/3625* (2013.01)

(58) Field of Classification Search
None
See application file for complete search history.

(56) References Cited

U.S. PATENT DOCUMENTS

| | | | |
|---|---|---|---|
| 1,025,312 | A | 5/1912 | Rydquist |
| 1,026,128 | A | 5/1912 | Rydquist |
| 1,084,598 | A | 1/1914 | Antone |
| 1,860,668 | A | 5/1932 | Gillet |
| 2,169,399 | A | 8/1939 | Steiner |

(Continued)

FOREIGN PATENT DOCUMENTS

| | | | |
|---|---|---|---|
| EP | 0933054 | A2 | 8/1999 |
| GB | 794825 | A | 5/1958 |

(Continued)

OTHER PUBLICATIONS

"The International Dispensing System" Catalog, Dispensing Dynamics International, 2010, pp. 1-60.

(Continued)

*Primary Examiner* — William A. Rivera
(74) *Attorney, Agent, or Firm* — Knobbe, Martens, Olson & Bear, LLP

(57) ABSTRACT

Various dispensing systems with drop-down features are disclosed. In certain embodiments, the dispensing system includes a roll support with a sensor and a piston. The sensor can move as the roll decreases in size (e.g., the outside diameter decreases) and can apply a force to the roll. The piston can move to become less engaged with the roll, such as becoming less received in a roll plug or the hollow core of the roll. When the roll has decreased to a threshold size, the piston substantially or fully disengages from the roll and/or the sensor applies a force to dislodge the roll from the roll support. This results in the roll automatically dropping off the roll support. The roll support is thus available to receive a fresh roll.

20 Claims, 24 Drawing Sheets

(56) References Cited

U.S. PATENT DOCUMENTS

| | | | | |
|---|---|---|---|---|
| 2,930,664 | A | 3/1960 | Liebisch | |
| 2,957,636 | A | 10/1960 | Lesavoy | |
| 3,010,669 | A * | 11/1961 | Layton | A47K 10/38 242/596.3 |
| 3,107,957 | A | 10/1963 | Batlas et al. | |
| 3,140,060 | A | 7/1964 | Layton et al. | |
| 3,613,880 | A | 10/1971 | Perrin | |
| 3,628,743 | A | 12/1971 | Bastian et al. | |
| 3,672,552 | A | 6/1972 | Krueger et al. | |
| 3,917,191 | A | 11/1975 | Graham, Jr. et al. | |
| 4,013,236 | A | 3/1977 | Perrin | |
| 4,106,684 | A | 8/1978 | Hartbauer et al. | |
| 4,165,138 | A | 8/1979 | Hedge et al. | |
| 4,192,442 | A | 3/1980 | Bastian et al. | |
| 4,203,562 | A | 5/1980 | DeLuca et al. | |
| 4,204,180 | A * | 5/1980 | Usui | B65H 23/005 226/11 |
| 4,317,547 | A | 3/1982 | Graham, Jr. et al. | |
| 4,358,169 | A | 11/1982 | Filipowicz et al. | |
| 4,403,748 | A | 9/1983 | Cornell | |
| 4,699,304 | A | 10/1987 | Voss et al. | |
| 4,756,485 | A | 7/1988 | Bastian et al. | |
| 4,807,824 | A | 2/1989 | Gains et al. | |
| 4,844,361 | A | 7/1989 | Granger | |
| 4,846,412 | A | 7/1989 | Morand | |
| 5,244,161 | A | 9/1993 | Wirtz-Odenthal | |
| 5,294,192 | A | 3/1994 | Omdoll et al. | |
| 5,302,167 | A | 4/1994 | Kley et al. | |
| 5,400,982 | A | 3/1995 | Collins | |
| 5,884,861 | A * | 3/1999 | Hosomi | B41J 2/32 242/563 |
| 5,979,822 | A | 11/1999 | Morand et al. | |
| 6,145,779 | A | 11/2000 | Johnson et al. | |
| 6,152,397 | A | 11/2000 | Purcell | |
| 6,224,010 | B1 | 5/2001 | Morand | |
| 6,237,871 | B1 | 5/2001 | Morand et al. | |
| 6,314,850 | B1 | 11/2001 | Morand | |
| 6,793,170 | B2 | 9/2004 | Denen et al. | |
| 6,871,815 | B2 | 3/2005 | Moody et al. | |
| 7,168,602 | B2 | 1/2007 | Broehl | |
| 7,270,292 | B2 | 9/2007 | Rasmussen | |
| 7,570,067 | B2 | 8/2009 | Denen et al. | |
| 8,282,033 | B2 | 10/2012 | Achton | |
| 9,326,647 | B2 * | 5/2016 | Larson | A47K 10/22 |
| 9,326,648 | B2 | 5/2016 | Trampolski | |
| 10,722,081 | B2 * | 7/2020 | Achton | A47K 10/38 |
| 10,966,578 | B2 * | 4/2021 | Zimmermann | A47K 10/3827 |
| 2003/0167893 | A1 * | 9/2003 | Morris | A47K 10/36 83/649 |
| 2008/0099595 | A1 | 5/2008 | Lewis et al. | |
| 2011/0253829 | A1 | 10/2011 | Goeking et al. | |
| 2015/0374181 | A1 | 12/2015 | Morand | |
| 2016/0242603 | A1 * | 8/2016 | Cvjetkovic | A47C 21/028 |
| 2019/0274490 | A1 | 9/2019 | Trampolski | |
| 2020/0147984 | A1 * | 5/2020 | Weeks | B41J 15/042 |
| 2021/0032063 | A1 * | 2/2021 | Janek | B65H 26/06 |

FOREIGN PATENT DOCUMENTS

| | | | |
|---|---|---|---|
| GB | 1114891 | A | 5/1968 |
| KR | 2002-0025446 | A | 4/2002 |
| WO | WO 02/100232 | A1 | 12/2002 |
| WO | WO 2009/150197 | A1 | 12/2009 |
| WO | WO 2010/046662 | A1 | 4/2010 |
| WO | WO 2014/200624 | A1 | 12/2014 |
| WO | WO 2019/173477 | A1 | 9/2019 |
| WO | WO 2020/210541 | A1 | 10/2020 |

OTHER PUBLICATIONS

"GP Towlmastr® Brown Series 2000 Roll Towel (X-Series). 7.4×450 ft. Brown. 12 rolls.", Baumann Paper Company, Inc., accessed Mar. 18, 2020, in 2 pages. URL: https://www.baumannpaper.com/show_product/GEP-19724.

International Search Report and Written Opinion, re PCT Application No. PCT/US2019/020958 dated Jun. 25, 2019.

International Preliminary Report on Patentability, re PCT Application No. PCT/US2019/020958 dated Sep. 17, 2020.

International Search Report and Written Opinion, re PCT Application No. PCT/US2020/027539 dated May 29, 2020.

International Search Report and Written Opinion, re PCT Application No. PCT/US2014/035778 dated Sep. 5, 2014.

International Preliminary Report on Patentability, re PCT Application No. PCT/US2014/035778 dated Dec. 23, 2015.

* cited by examiner

DISPENSER WITH AUTOMATIC STUB ROLL DROP DOWN

CROSS REFERENCE

This application claims the priority benefit of U.S. Provisional Patent Application No. 62/833,271, filed Apr. 12, 2019, the entirety of which is incorporated by reference herein.

BACKGROUND

Field

This disclosure generally relates to an apparatus for dispensing consumable material, such rolls of paper towels.

Description of Certain Related Art

Tissue dispensers provide a convenient storage system for rolls of consumable material. The rolls of consumable material can be referred to as "tissue rolls," for example, rolls of fibrous paper products or tissue paper (e.g., bathroom tissue, paper towels, or other). Tissue dispensers are generally designed to hold one or multiple rolls of tissue paper and to provide a dispensing mechanism. The dispensing mechanism generally allows a user to retrieve a length of the roll. As one length of the tissue paper is dispensed, an additional length becomes available. This process slowly depletes the roll. A roll that has been almost depleted can be called a "stub roll."

SUMMARY OF CERTAIN FEATURES

It can be desirable to replace a stub roll before it becomes completely exhausted. Running out of tissue in an unexpected moment can be problematic for a user. This can be especially the case where the user is not able or allowed to replace the exhausted roll with a fresh roll, such as in the case of a locked or otherwise secured tissue dispenser. One situation in which this can occur is in a bathroom with a regular (e.g., daily or weekly) maintenance schedule. Leaving the stub roll in the tissue dispenser until the next maintenance period risks exhausting the roll in the interim period. On the other hand, replacing the stub roll wastes the tissue remaining on the stub roll.

It can be advantageous to maintain the stub roll in the dispenser and allow further dispensation of the remaining material from the stub roll. This can enable the stub roll to be fully used. It can also be advantageous to automatically move the stub roll out of the way, thereby allowing space for a fresh roll (e.g., a full roll) to be installed in the dispenser and/or reducing the number of steps to install a new roll in the dispenser (e.g., maintenance personnel may not be required to remove an old roll before installing a new roll). For example, it can be helpful to move the stub roll from a main location to a secondary location. It can be advantageous for status of the dispenser to be readily apparent to a user, such as by visual inspection. For example, it can be beneficial for a user (e.g., maintenance staff) to see whether a roll in the dispenser is in the main or secondary location and/or whether the dispenser is in a condition to receive a fresh roll. The technology of this disclosure addresses one or more of the aforementioned concerns or aims, or others.

In certain embodiments, a dispensing system includes a casing comprising a roll support that supports a roll of tissue paper. The roll support can have a sensor and a piston. The sensor can move as the roll decreases in size (e.g., the outside diameter decreases) and can apply a force to the roll. Due to an operational connection of the sensor and piston, the movement of the sensor can cause the piston to move too. For example, the piston can move to become less engaged with the roll, such as becoming less received in a roll plug or the hollow core of the roll. Eventually, when the roll has decreased to a threshold size, the piston substantially or fully disengages from the roll and/or the sensor applies a force to dislodge the roll from the roll support. This results in the roll (now a stub roll) automatically dropping, such as at least partly by force of gravity, from a main position to a secondary position. The roll support is thus available to receive a fresh roll in the main position.

According to some implementations, a dispensing system is configured to dispense from a roll of tissue, such as a roll of paper towels, paper napkins, or toilet tissue. The dispensing system can include a casing and a roll support in the casing. In some implementations, the system includes a dispensing mechanism in the casing. The roll support can support an end of the roll. A second roll support can support another end of the roll. In some embodiments, the roll support is mounted to the casing or the dispensing mechanism.

The roll support can include a sensor that is configured to engage an outside of the roll. The sensor can be configured to move (e.g., pivot, extend, etc.) in response to a decrease in a size (e.g., diameter) of the roll. In some embodiments, the sensor is configured to pivot about a fulcrum.

The roll support can include a biasing member. In some implementations, the biasing member biases the sensor such that the sensor applies a force against the outside of the roll. The biasing member can be a spring, such as a torsion, wave, leaf, or helical spring.

The roll support can include a piston. The piston can be at least partly receivable inside a hollow core or a roll plug of the roll. In certain variants, the piston comprises a hub configured to slide in a direction that is generally parallel to an axis of rotation of the roll. The piston can be operably connected with the sensor such that the piston progressively moves (e.g., slides, retracts, etc.) out of the hollow core or roll plug as the sensor moves. In certain implementations, the operative connection between the sensor and piston transmits pivoting motion of the sensor into translational motion of the piston. In some variants, the amount of movement of the sensor and piston are linearly related.

The roll support can be configured such that, when the roll reaches a threshold size, the roll automatically drops off the roll support at least partially by force of gravity. In some embodiments, the threshold size comprises an outside diameter. For example, the threshold size can be an outside diameter of less than or equal to about 3.5 inches.

In certain implementations, the sensor comprises a first face and a second face, the sensor configured such that the first face engages the outside of the roll when the roll is substantially full and the second face engages the outside of the roll when the roll is substantially empty but has not yet reached the threshold size. In some embodiments, when the first face is engaged with the outside of the roll, the sensor applies a force to the roll in a direction that is generally parallel to an axis of rotation of the roll; and/or when the second face is engaged with the outside of the roll, the sensor applies a force to the roll in a direction that is generally perpendicular to the axis of rotation of the roll.

In some implementations, the dispensing mechanism comprises a transfer module. The transfer module can be configured to dispense tissue from the roll after the roll has dropped off the roll support.

According to some implementations, a dispensing system that is configured to dispense tissue from a roll can include a casing and a dispensing mechanism in the casing. The dispensing system can include a first roll support and a second roll support. The first and second roll supports can be configured to support the roll within the casing and/or to allow the roll to rotate about an axis of rotation.

The first roll support can include a frame, such as a structural support. The frame can be generally rigid. A sensor can be connected to the frame. The sensor can be configured to detect a size of the roll. The sensor can be movable between a first (e.g., retracted) position and a second (e.g., extended) position. The sensor can be biased toward the second position.

A piston can be connected to the frame. The piston can be movable between a first (e.g., protruding) state and a second (e.g., withdrawn) state. In the first state, the piston can be received inside a hollow core or a roll plug of the roll and in the second state the piston can be substantially or completely withdrawn from the hollow core or the roll plug.

The piston and sensor can be operably connected. For example, in some implementations, as the sensor moves from the first position to the second position, the piston moves from the first state to the second state. In certain implementations, the sensor is pivotable between the first position and the second position and the piston is slidable between the first position and the second position.

In several embodiments, the sensor is configured to detect the size of the roll by abutting against the roll. In some implementations, the sensor comprises a first face and a second face. The first face can be configured to engage against the roll when the sensor is in the first position. The second face can be configured to engage against the roll when the sensor is in the second position.

In certain variants, the roll support is further configured such that, when the first face is engaged with the roll, the sensor applies a force to the roll in a direction that is generally parallel to the axis of rotation of the roll; and/or when the second face is engaged with the roll, the sensor applies a force to the roll in a direction that is generally perpendicular to the axis of rotation of the roll.

Some implementations of a dispensing system that is configured to dispense tissue from a roll, in which the size of the roll progressively decreases as the roll is dispensed, includes a first roll support and a second roll support. The first and second roll supports can be configured to support the roll within a casing and to allow the roll to rotate about an axis of rotation. The roll can be dispensed by a dispensing mechanism in the casing. The first roll support can include a first actuator (e.g., a sensor) and a second actuator (e.g., a piston). The first actuator can be configured to apply a force to an outside of the roll. The second actuator can be engageable with (e.g., receivable within) the roll. In certain implementations, the first actuator comprises a pivotable lever and/or the second actuator comprises a slidable hub.

The first roll support can be configured such that, as the size of the roll decreases, the first actuator transitions from applying the force to an axial end of the roll to an outside diameter of the roll; and/or the second actuator disengages from (e.g., withdraws at least partly from inside) the roll. In some variants, the first roll support is further configured such that, as the size of the roll decreases to a threshold amount, the force applied by the first actuator dislodges the roll from the first roll support.

For purposes of summarizing the disclosure, certain aspects, advantages, and features of the technology have been described herein. Not necessarily any or all such advantages are achieved in accordance with any particular embodiment of the technology disclosed herein. No aspects of this disclosure are essential or indispensable. Neither the preceding summary nor the following detailed description purports to limit or define the scope of protection. The scope of protection is defined by the claims.

BRIEF DESCRIPTION OF THE DRAWINGS

Certain features of this disclosure are described below with reference to the drawings. The illustrated embodiments are intended to illustrate, but not to limit the embodiments. Various features of the different disclosed embodiments can be combined to form further embodiments, which are part of this disclosure.

DETAILED DESCRIPTION OF CERTAIN EMBODIMENTS

Various dispensing systems are described. Certain embodiments of the dispensing systems are described in the context of a roll of paper towels, due to particular utility in that context. However, the embodiments and inventions disclosed herein can also be applied to rolls of other types of consumable materials, such as tissue paper, bathroom tissue, facial tissue, napkins, cleaning (e.g., sanitizing) wipes, or otherwise. No features, structure, or step disclosed herein is essential or indispensable.

1. Overview

Figure 1:
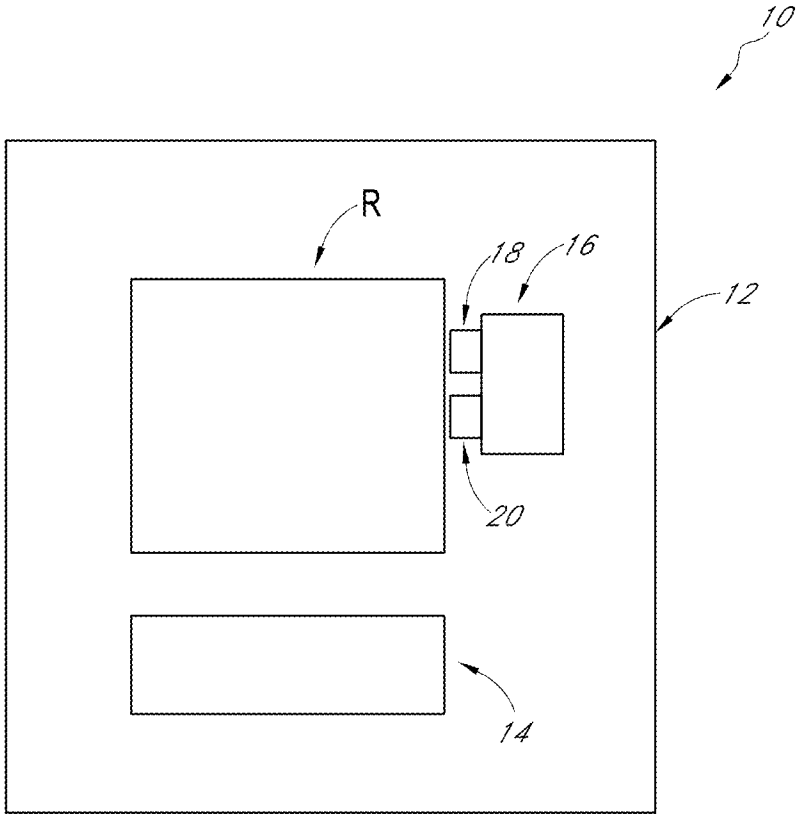
FIG. 1 schematically illustrates a dispensing system.

FIG. 1 schematically illustrates an embodiment of a dispensing system 10. The dispensing system 10 can comprise a paper towel dispenser, toilet paper dispenser, facial tissue dispenser, rolled napkin dispenser, wipes dispenser, or other type of dispenser. The dispensing system 10 can be configured to dispense product that is wound on a core, such as a roll R of paper tissue.

The dispensing system 10 can include an outer casing 12, dispensing mechanism 14, and roll support 16. The dispensing mechanism 14 can dispense material from a roll R that is at least partially supported on the roll support 16. The roll support 16 can include a first actuation mechanism 18. The roll support 16 can include a second actuation mechanism 20. The first actuation mechanism 18 can be configured to detect a size (e.g., outside diameter) of the roll R. The second actuation mechanisms 20 can support the roll R, such as by being received in a hollow core of the roll R and/or engaging a roll plug of the roll R. The second actuation mechanisms 20 can be operably connected to the first actuation mechanism 18, such that in response to the first actuation mechanism 18 detecting that the roll R has decreased to a threshold size, the second actuation mechanisms 20 substantially or completely disengages from the roll R. This results in the roll R (now a stub roll) automatically dropping to a secondary position, thereby making space available for a fresh roll to be added into the dispensing system 10. In some embodiments, the dispensing mechanism 14 is configured to continue dispensing material from the dropped stub roll and then (e.g., in response to the stub roll being exhausted) to transfer to dispensing from a main roll. The dropped stub roll can be housed in a front portion or rear portion of the casing 12.

FIGS. 2-5 illustrate another dispensing system 110, also called a dispenser. The dispensing system 110 can include any one or more of the features of the dispensing system 10. The illustrated embodiment is the context of a roll of paper towels, but the dispenser 110 is not limited to that use only and can be used with a variety of consumable materials.

The dispensing system 110 can include an outer casing 112, also called a housing. The casing 112 can be made of plastic, metal or any suitable material (e.g., ABS polyethylene, polypropylene and/or other polymers). The casing 112 can comprise an enclosure for other system components. The casing 112 can include a front 112*a* and a back 112*b*. The back 112*b* can include a plurality holes and/or connector mechanisms for engaging with a wall or other structure for mounting the tissue dispenser (e.g., in a bathroom or other location). The front 112*a* can be hingedly attached with the rear 112*b*, for example, at a hinge 112*c* of the casing 112. The casing 112 can include a locking mechanism that secures the front and back, 112*a* 112*b*, thereby limiting access to an inside of the casing 112. The locking mechanism can require a key or other specialized tool to open the casing 112. The casing 112 can include a viewing area, such as a clear window, on the front, top, or sides. The viewing window can enable a user to see the status of a roll R, such as whether the roll R is in a main dispensing position, thereby revealing whether the dispensing system 110 is due to receive a fresh (e.g., full) roll.

The dispensing system 110 can include a dispensing mechanism 114. The dispensing mechanism 114 can be configured to draw the consumable material from the roll R and to dispense such material to a user. The dispensing mechanism 114 can be operated by an actuator, such as a wheel on the side of the dispensing system 110 as shown. The wheel can be ramped to encourage only one direction of rotation. In some embodiments, the actuator comprises a lever, push-bar, button, or otherwise.

In certain implementations, the dispensing mechanism 114 includes a transfer module. The transfer module can be configured to switch (e.g., sequentially and/or automatically) between dispensing product from a stub roll to dispensing product from a main roll. In some implementations, the dispenser 110 is configured to dispense, in series, tissue material from the stub roll and then tissue material from the main roll. In certain variants, the transfer module is configured to reduce or avoid concurrently dispensing tissue material from the stub and main rolls. This can decrease waste and/or can conceal from a user that multiple rolls of tissue are present. The dispenser system 110 can include any of the features, such as those related to transfer technology, disclosed in U.S. Patent Application Publication No. 2019/0274490, which is incorporated by reference herein in its entirety.

The dispensing system 110 can include a roll support 116. The roll support 116 can at least partially support the roll R, such as an axial side of the roll R. In some embodiments, the dispensing system 110 includes a second roll support 116*a*, which can support an opposite axial side of the roll R. The roll supports 116, 116*a* can hold the roll R in a main position. The roll supports 116, 116*a* can be received in a roll plug or the hollow core of the roll R. The roll supports 116, 116*a* can have the same configuration or different configurations. For example, in the embodiment shown, the roll support 116 is a dynamic mechanism that provides drop-down functionality and the second roll support 116*a* is a static projection (e.g., a non-moving stub or plug). In various embodiments, the roll R rotates on the roll supports 116, 116*a*.

Figure 5:
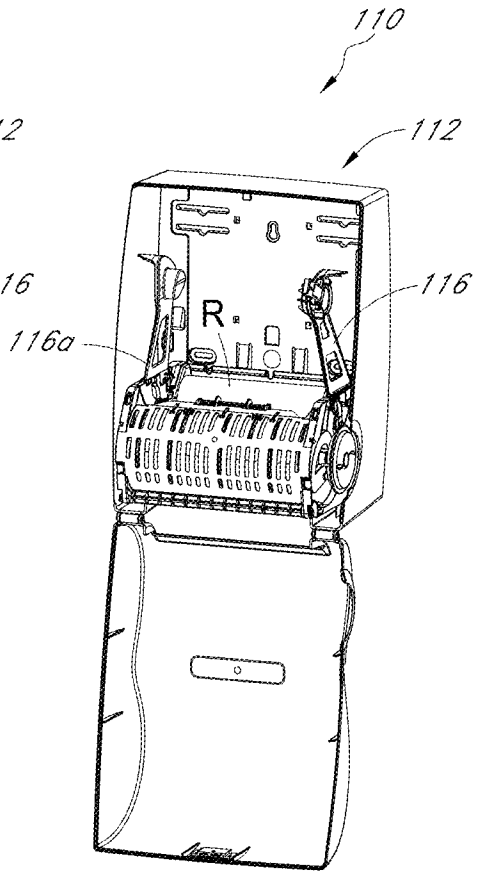
FIG. 5 illustrates the dispensing system with the roll support disengaged from the roll, the roll having moved to a secondary dispensing location.
Figure 4:
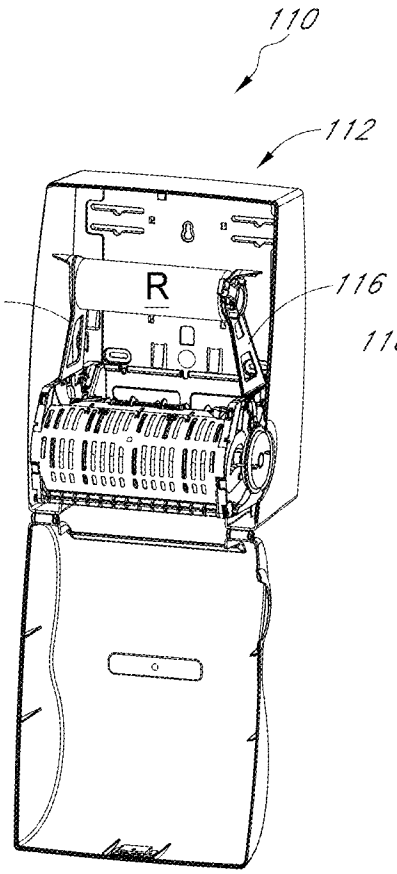
FIG. 4 illustrates the dispensing system with the roll support engaged with a nearly exhausted roll.
Figure 3:
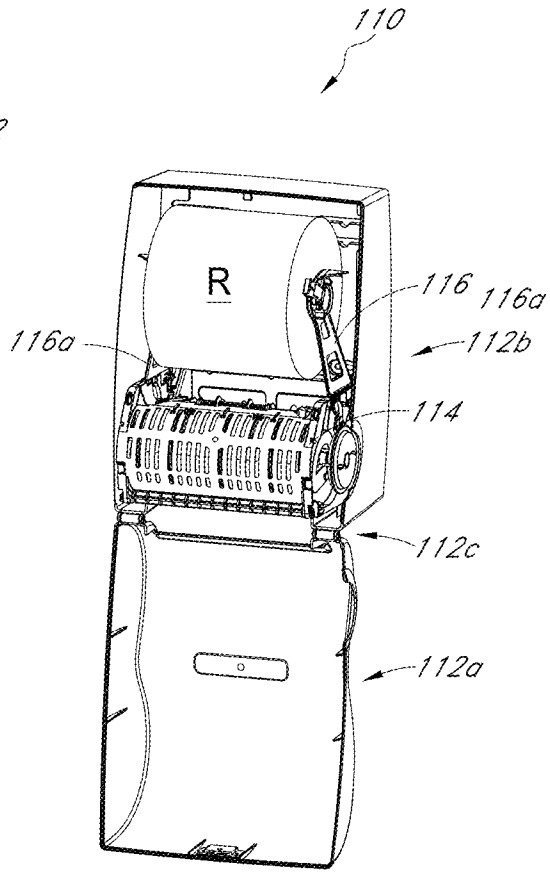
FIG. 3 illustrates the dispensing system with a cover in an open position and a roll support engaged with a full roll, the roll being in a main dispensing location.
Figure 2:
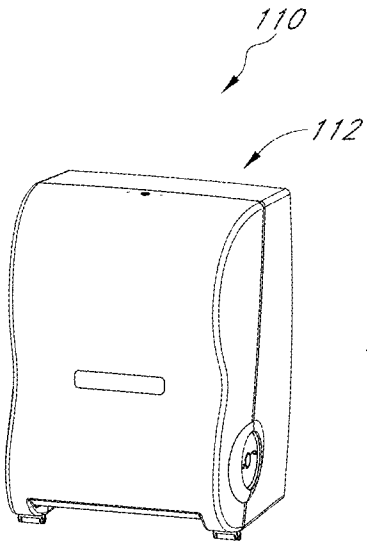
FIG. 2 illustrates another dispensing system.

The roll R can be held in the main position in a fresh state (FIG. 3) through use to a nearly exhausted state (FIG. 4). As discussed in more detail below, when or in response to the roll R having decreased to a threshold size (e.g., outside diameter), the roll support 116 can disengage from the roll R, thereby automatically dropping the roll R, such as at least partly by force of gravity, from the main position to a secondary position (FIG. 5). The roll support 116 is thus available to receive a fresh roll in the main position. In some embodiments, the absence of a roll on the roll support 116 provides a ready visual indicator (e.g., to janitorial staff) that the dispenser 110 is ready to receive a fresh roll.

Figure 6B:
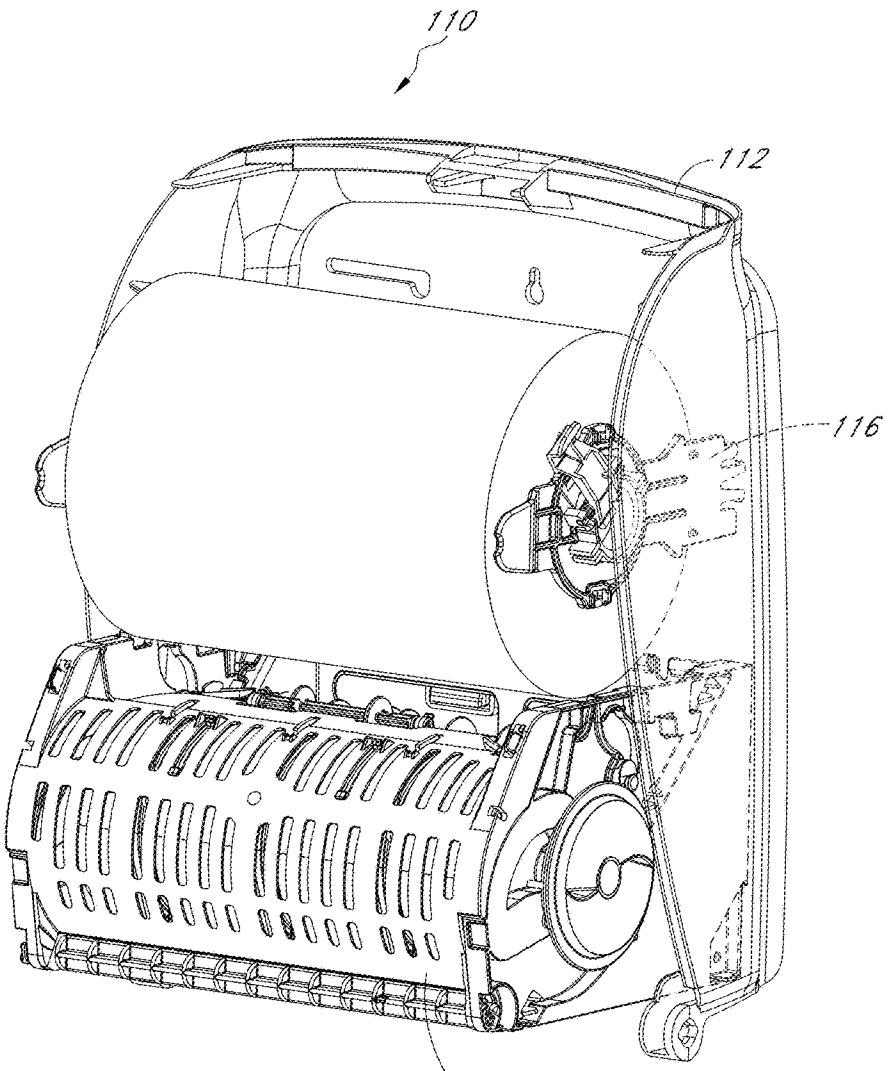
FIGS. 6A and 6B illustrate the dispensing system with the roll support connected to a dispensing mechanism and a casing, respectively.
Figure 6A:
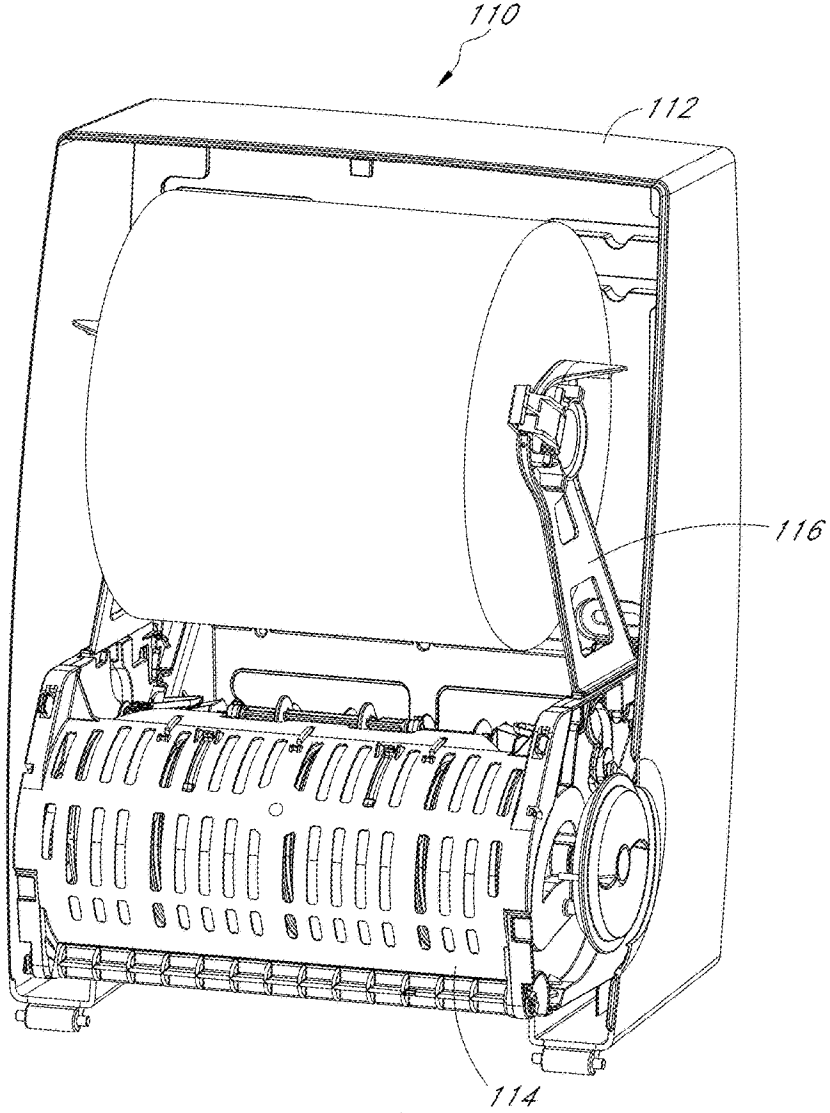

The roll supports 116, 116*a* can be connected to other system components. For example, one or both of the roll supports 116, 116*a* can be connected to the dispensing mechanism 114 (FIG. 6A) and/or the casing 112 (FIG. 6B). The different connection locations can allow for different configurations of the casing 112 and other components, such as is shown in FIGS. 6A and 6B. One or both of the roll supports 116, 116*a* can comprise a cantilevered arm. In the embodiment illustrated, the roll support 116 is on the right side. In some variants, the roll support 116 is on the left side. As illustrated, the roll supports 116, 116*a* can be positioned such that an axis of rotation of the roll R intersects sides of the casing 112. In certain variants, such as in the context of certain toilet tissue dispenser variants, the roll supports 116, 116*a* can be configured such that the axis of rotation of the roll R intersects the front and back of the casing 112. For example, the roll support 116 can be on one of the front and back and the second roll support 116*a* can be on the other of the front and back.

2. Roll Support

FIGS. 7A-7G illustrate an example of the roll support 116. The roll support 116 can include a first actuation mechanism, such as a sensor 118 and a second actuation mechanism, such as a piston 120. The interaction of the sensor 118 and piston 120 with the roll R can provide drop-down functionality, as discussed in more detail below.

The roll support 116 can include a frame that supports the sensor 118 and piston 120. The frame can include a first end 122*a* and a second end 122*b*. The first end 122*a* can include features to connect with other system components. For example, as shown, the first end 122*a* can include projections and/or recesses that mate with corresponding features on the casing 112 and/or dispensing mechanism 114. The second end 122*b* can be cantilevered and/or can be a free end within the dispenser 110. As illustrated, the second end 122*b* can include a head portion, such as a portion that is bulbous and/or larger in size than a middle portion of the frame. As illustrated, the frame can include one or more apertures. In some embodiments, the frame is angled, such that the second end 122*b* is closer to a middle of the dispenser 110 than the first end 122*a*. The second end 122*b* can include an ear 123 that projects outwardly. The ear 123 can engage the casing 112, which provides stability and/or support for the roll R. For example, the ear 123 can reduce lateral rocking of the roll R. The second roll support 116*a* can include an ear 123 too.

As mentioned above, the roll support 116 can include the sensor 118. The sensor 118 can be configured to detect a size of the roll R. For example, in some embodiments, the sensor 118 engages with (e.g., contacts or abuts against) the roll R, such as against an outside diameter or axial end of the roll R. As the roll R decreases in size (e.g., the outside diameter decreases), the sensor 118 can move. For example, the sensor 118 can move to remain in contact with the roll R. In some embodiments, such movement of the sensor 118 occurs at least partly due to the sensor 118 being energized by a biasing member 128, such as a torsion or other type of spring. In various embodiments, the sensor 118 is configured to extend in response to a decrease in a size of the roll R.

In various embodiments, the sensor 118 comprises a pivoting member, such as a lever. As illustrated, the sensor 118 can extend radially outward from a radial center of an end of the roll support 116. The sensor 116 can have an outer end, an inner end, and a fulcrum 129 between the outer and inner ends. The inner end can connect to the piston 120. The sensor 118 can be configured to pivot about the fulcrum 129. In some embodiments, the fulcrum 129 comprises a pinned connection.

The outer end can include one or more faces that engage with the roll R. For example, the outer end can include a first face 124 and a second face 125. As discussed in more detail below, the faces 124, 125 can contact the roll R, such as an axial end or outside diameter of the roll R. For example, in some implementations, in an initial state (e.g., when the roll is full) the first face 124 engages (e.g., presses against or contacts directly or indirectly) the roll R and in a subsequent state (e.g., when the roll is nearly exhausted) the second face 125 engages the roll R. In some variants, when engaged with the roll R, the first face 124 abuts an axial end of the roll R, is generally parallel with the axial end of the roll R, and/or applies a force to the roll R in a direction that is generally parallel to the axis of rotation of the roll R. In certain embodiments, when engaged with the roll R, the second face 125 abuts an outside diameter of the roll R, is generally perpendicular to the axial end of the roll R, and/or applies a force to the roll R in a direction that is generally perpendicular to the axis of rotation of the roll R. The faces 124, 125 can be connected (e.g., directly) to each other. The faces 124, 125 can be at an angle relative to each other, such as at least about: 45°, 60°, 75°, 80°, 90°, 100°, 110°, 120°, or otherwise. The first face 124 can be located outward of the second face 125 and/or the second face 125 can be located closer to the piston 120 than the first face 124. The biasing member 128 can bias the sensor 118 such that at least one of the faces 124, 125 is pressed against the roll R and/or toward a middle of the dispenser 110.

In some embodiments, the sensor 118 includes a user interface element 126, such as a tab or handle. The user interface element 126 can be configured to enable a user to readily manipulate (e.g., move) the sensor 118. The user interface element 126 can be located on an endmost portion of the sensor 118 and/or nearer to the endmost portion of the sensor 118 than the first face 124. The user interface element 126 can be generally parallel to the first face 124. In some embodiments, the user activates (e.g., depresses, pulls, and/or grabs) the user interface element 126 during installation of the roll R into the main position. This can move the sensor 118 out of the way and facilitate installation of the roll R onto the roll support 116.

Figure 7C:
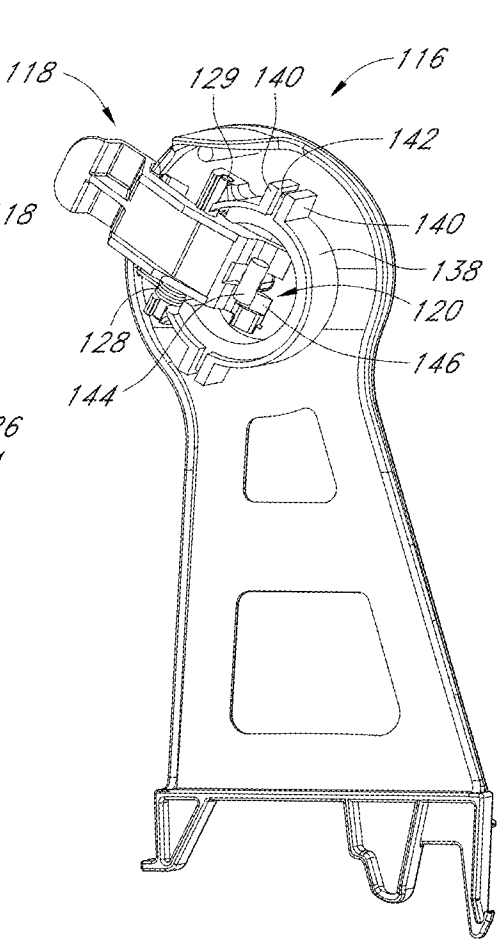
FIGS. 7A-7G illustrate various views of the roll support.
Figure 7B:
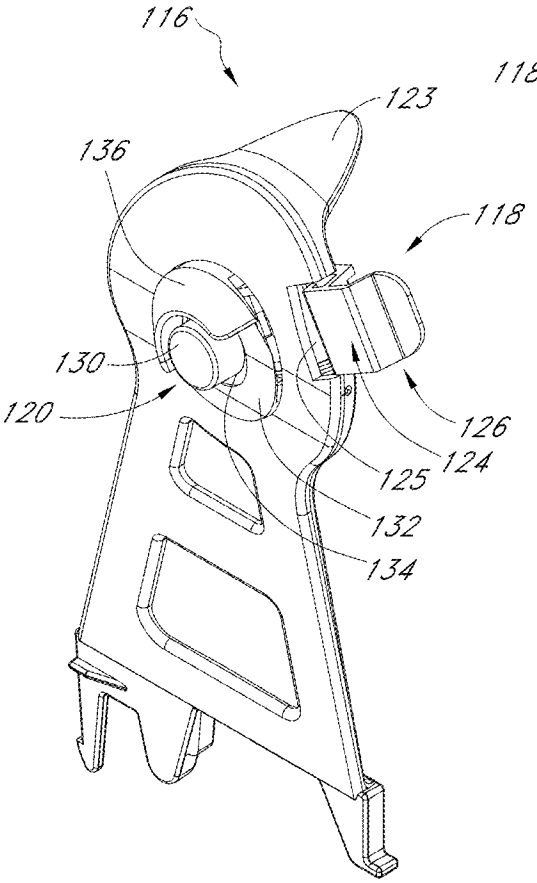
Figure 7A:
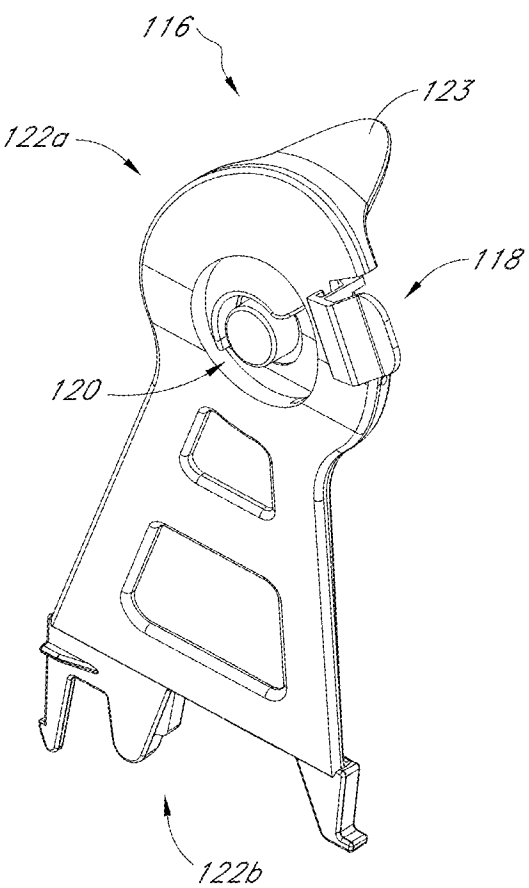
Figure 7E:
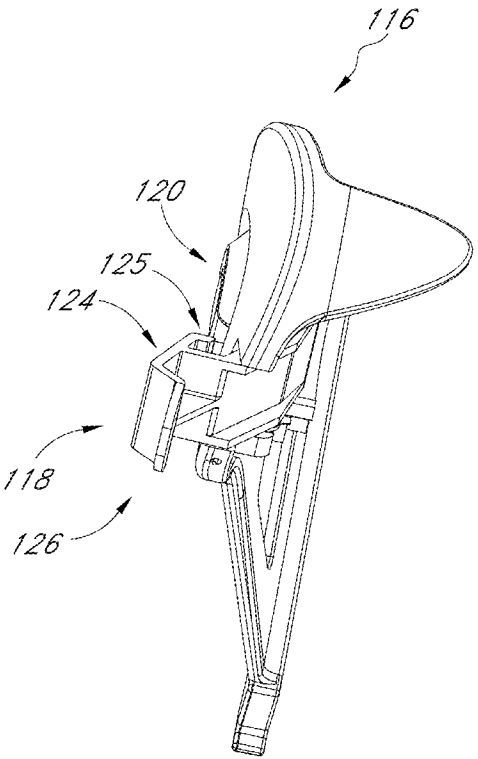
Figure 7D:
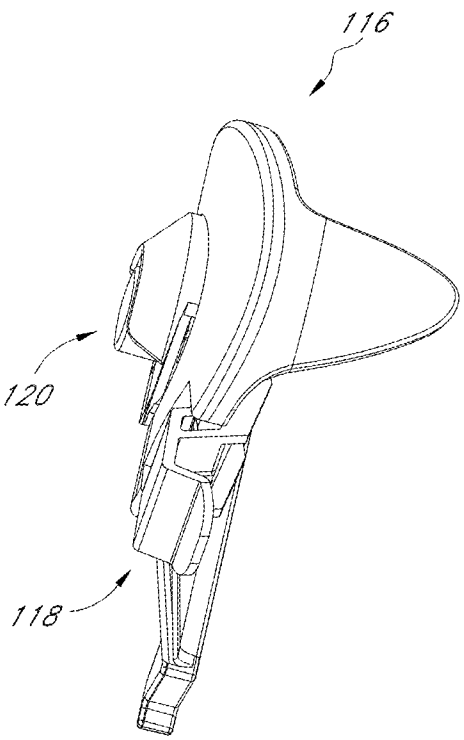
Figure 7G:
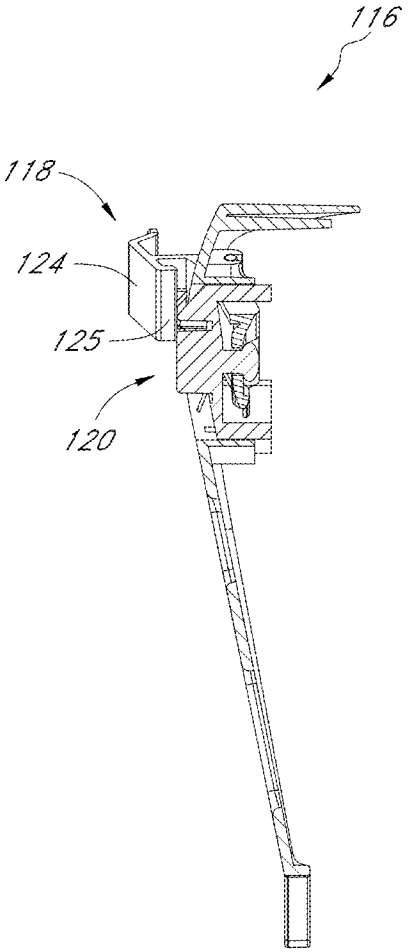
Figure 7F:
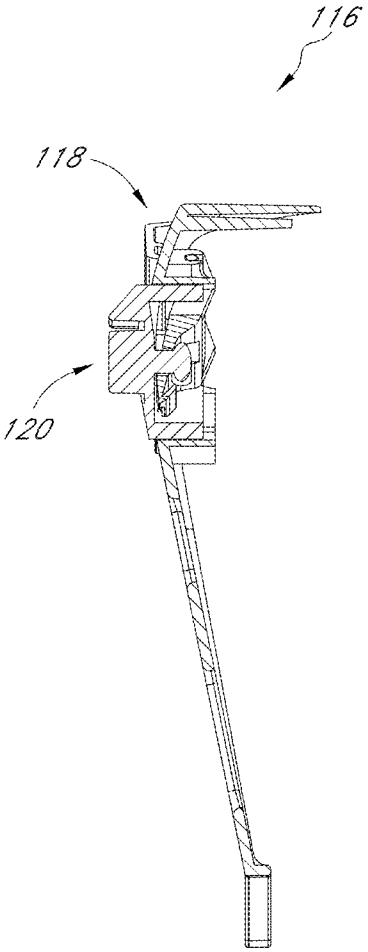

The sensor 118 can be positioned in various locations around the head of the frame of the roll support 116. As illustrated, in certain embodiments, the sensor 118 is positioned toward the back 112*b* of the dispenser 110. This can put the sensor 118 in a convenient position, such as a position such that the sensor 118 does not interfere with insertion of a fresh roll with and/or so that the sensor automatically engages a newly installed roll (e.g., without requiring the user to manually move or position the sensor 118). In some variants, the sensor 118 is positioned toward the front 112*a* of the dispenser 110. The sensor 118 can be positioned anywhere around the piston 120. The sensor 118 can extend outward of the piston 120. For illustrative purposes, certain figures, such as FIGS. 7F and 7G, depict an arrangement with the sensor 118 positioned on the back half of the roll support 116. As mentioned above, other embodiments have the sensor 118 in other positions, such as on the front half of the roll support 116. In some variants, the sensor 118 is in the 3 o'clock, 6 o'clock, 9 o'clock, or 12 o'clock position. In other variants, the sensor 118 is in the 1 o'clock, 4 o'clock, 7 o'clock, or 10 o'clock position.

As mentioned above, the roll support 116 can include the piston 120. The piston 120 can include features that mate with corresponding features on a roll plug and/or a core of the roll R. In the embodiment illustrated, the piston 120 includes a hub 130, such as a generally cylindrical element. The hub 130 can have an outer end, which can be generally planar (e.g., flat), as shown. The piston 120 can include a land 132, such as generally flat region, that surrounds and/or is located radially outward of the hub 130. Some variants have a groove 134 that surrounds the hub 130 and/or is located radially between the hub 130 and the land 132. The piston 120 can include a ramped surface 136. The ramped surface can be located radially outward of the hub 130 and/or extend around at least a portion of a periphery of the piston 120. For example, the ramped surface 136 can extend around the periphery at least about: 90°, 120°, 150°, 180°, 210°, 240°, 270°, or otherwise. In some embodiments, the ramped surface 136 can facilitate dropping of the roll R, such as by providing a surface for the end of the roll to slide on. In some embodiments, the ramped surface 136 can be configured to facilitate installation of the roll R, such as by acting as a cam. In various embodiments, the hub 130, land 132, groove 134, and/or ramped surface are configured to mate with corresponding features on a roll plug and/or a core of the roll R.

The piston 120 can move (e.g., slide) relative to the frame of the roll support 116. The piston can be located in an opening (e.g., a through hole) in the frame. As illustrated, the piston 120 can be centrally located in the head of the frame. The frame can include, such as on a rear side, a guide wall 138. The guide wall 138 can extend in an axial direction and/or can surround at least a portion of the periphery of the piston 120. The guide wall can include a first guide element 140, such as a track. As illustrated, the track can include a plurality of flanges. The piston 120 can include a second guide element 142, such as a projection that engages with the track. As illustrated, the projection can comprise a radially outwardly extending wing that is circumferentially received between (e.g., sandwiched between) the flanges. Some embodiments include multiple first and second guide elements 140, 142. For example, the embodiment illustrated includes first and second guide elements 140, 142 located approximately 180° apart.

Figure 15A:
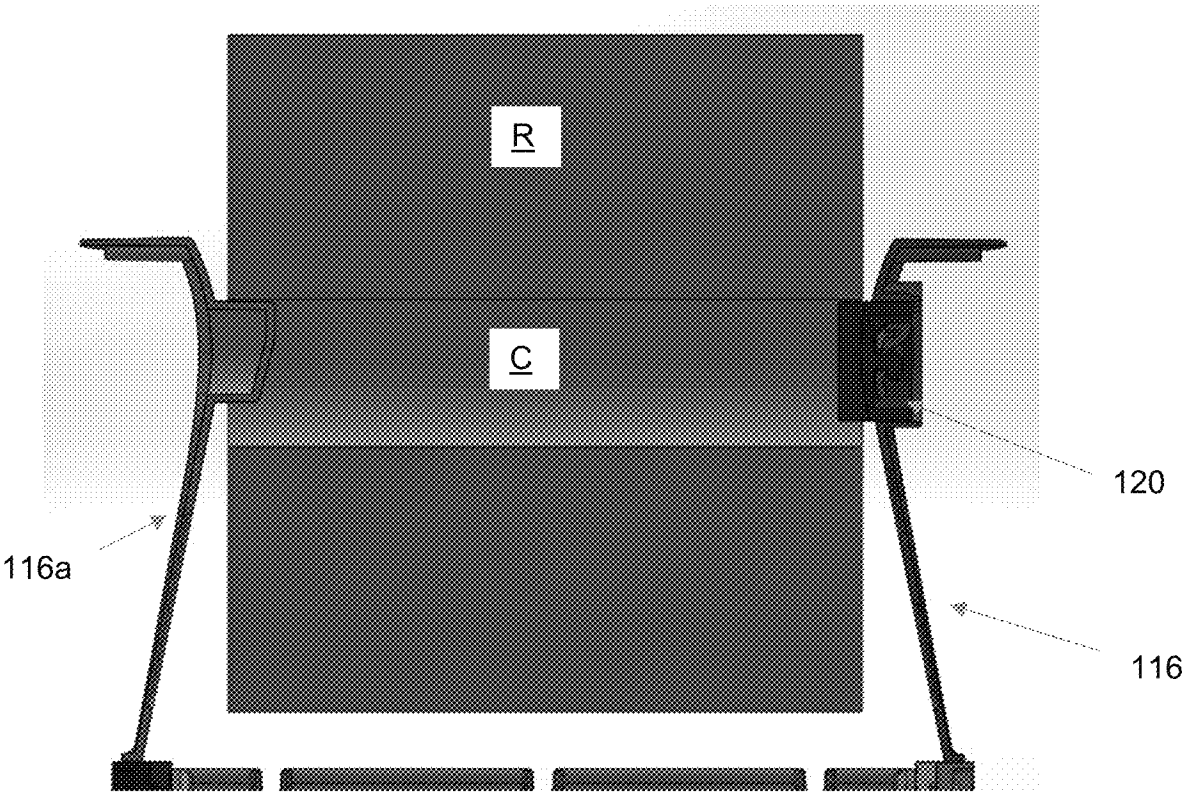
FIGS. 15A and 15B illustrate cross-sectional views of a roll support that is engaged with a hollow core of the roll.
Figure 15B:
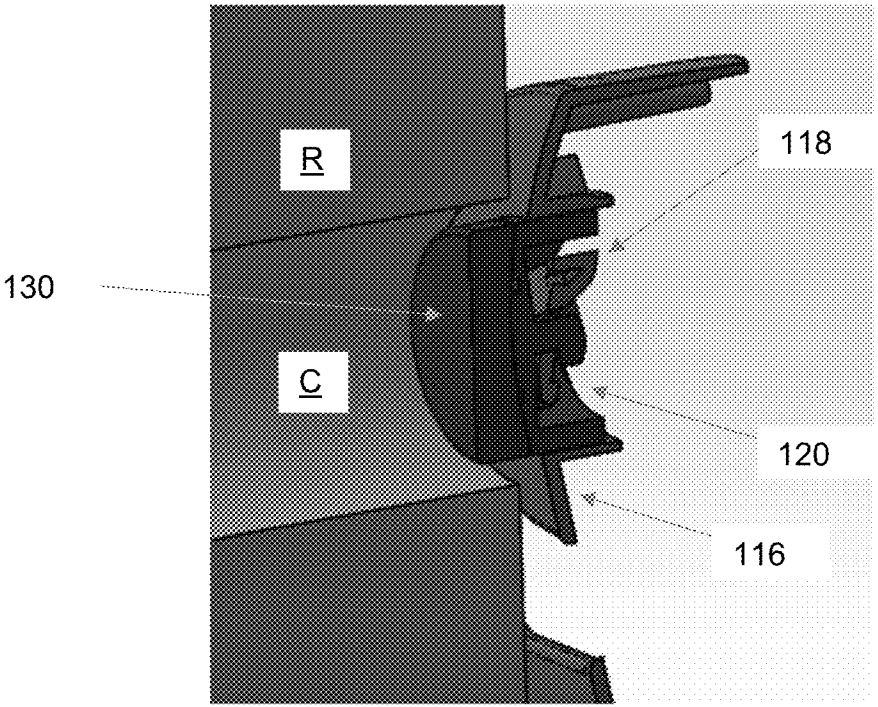

The sensor and piston 118, 120 can be positioned on the second end 122*b* of the roll support 116. The piston 120 can move (e.g., slide) within the end of the roll support 116. In some embodiments, the piston 120 moves in a direction generally parallel with the axis of rotation of the roll R. In an extended position, the piston 120 can support the roll R, such as by being received in a hollow core of the roll R and/or abutting an axial end side of the roll R. In certain implementations, the piston 120 is configured to engage with a roll plug positioned in the hollow core of the roll R, such as having a mating size and shape as the roll plug. In some variants, the piston 120 engages the hollow core C directly and/or without a roll plug, as is illustrated in the example shown in FIGS. 15A and 15B. For purposes of presentation, in FIGS. 15A and 15B, an outer end of the sensor is not shown and, in FIG. 15B, the roll R is displaced upward off the hub 130 (typically the roll R will ride on the hub 130, such as is shown in FIG. 15A). In some embodiments, the piston 120 is configured to engage with a "coreless" roll. The dispenser 110 can be configured for use with proprietary or non-proprietary roll plug or core configurations.

The piston 120 can be operably connected with the inner end of the sensor 118 in such a way that movement of the sensor 118 is transmitted into movement of the piston 120. For example, the piston 120 can be connected to the sensor 118 by a pinned connection. As shown in FIG. 7C, the piston 120 include a head portion 144, such as a laterally (e.g., radially-outwardly) extending pin, which can be positioned on an axially extending strut. As shown, the pin and strut can comprise a generally "T" shape. The head portion 144 can be received in a receiving portion 146 in the sensor 118. The receiving portion 146 can include a plurality of arms and/or a channel, such as a through hole. The strut can extend through the channel. The channel can have an opening to permit insertion of the strut. The arms can engage with the pin. The piston 120 and sensor 118 can be separate components that are operably connected. In some variants, the piston 120 and sensor 118 are unitarily formed and/or are rigidly connected. The piston 120 can include an inner chamber. In some embodiments, such as is shown, the inner end of the sensor 118 and/or the connection between the sensor 118 and piston 120 is within the inner chamber. The head portion 144 can be recessed within and/or not protrude out of the chamber. As illustrated, the piston 120 can be closed on one end (e.g., by the hub 130) and open on the other end.

The sensor 118 and piston 120 can be operably connected. In certain implementations, pivoting movement of the sensor 118 is transferred into translational movement of the piston 120. The amount of respective movement of the sensor 118 and piston 120 can be related, such as being linearly related, directly related, or otherwise. In various embodiments, the outer end of the sensor 118 and the piston 120 are opposing related, such as moving in opposite directions. For example, in some implementations, when the outer end of the sensor 118 is extended the piston 120 is retracted and/or when the outer end of the sensor 118 is retracted the piston 120 is extended. As shown in FIGS. 7D and 7E, as the sensor 118 moves in one direction (e.g., from right to left), the piston 120 moves in the opposite direction (e.g., from left to right).

3. Operation

The dispenser 110 can be configured to drop automatically the roll R when a condition occurs. In various embodiments, the drop occurs in response to detecting that the roll R has reach a threshold size, such as a minimum outside diameter. The size at which the roll drops can vary, such as based on the size of the dispenser 110, the size of the roll, characteristics of the consumable material, etc. In some embodiments, the threshold size is an outside diameter of less than or equal to about: 4.0 inches, 3.5 inches, 3.0 inches, 2.5 inches, 2.0 inches, or otherwise. In various implementations, the roll R is dropped when the roll has become a stub roll. In certain variants, the roll has becomes a stub roll when the roll's outside diameter is less than or equal to about 3.5 inches or less than or equal to about 2.5 inches.

Figure 8B:
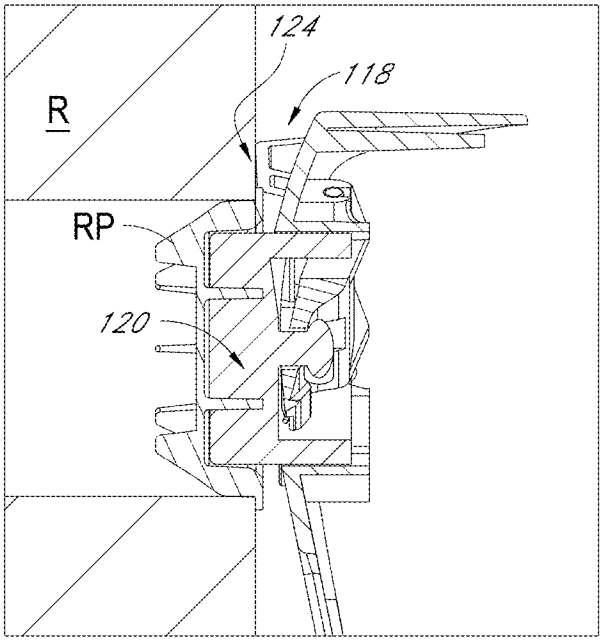
FIGS. 8A-8D illustrate front cross-sectional, close-up, side, and top views of portions of the dispenser system with the roll support engaged with a tissue roll. For the side view of FIG. 8C, the roll is illustrated as transparent and in dashed lines for purposes of presentation.
Figure 8A:
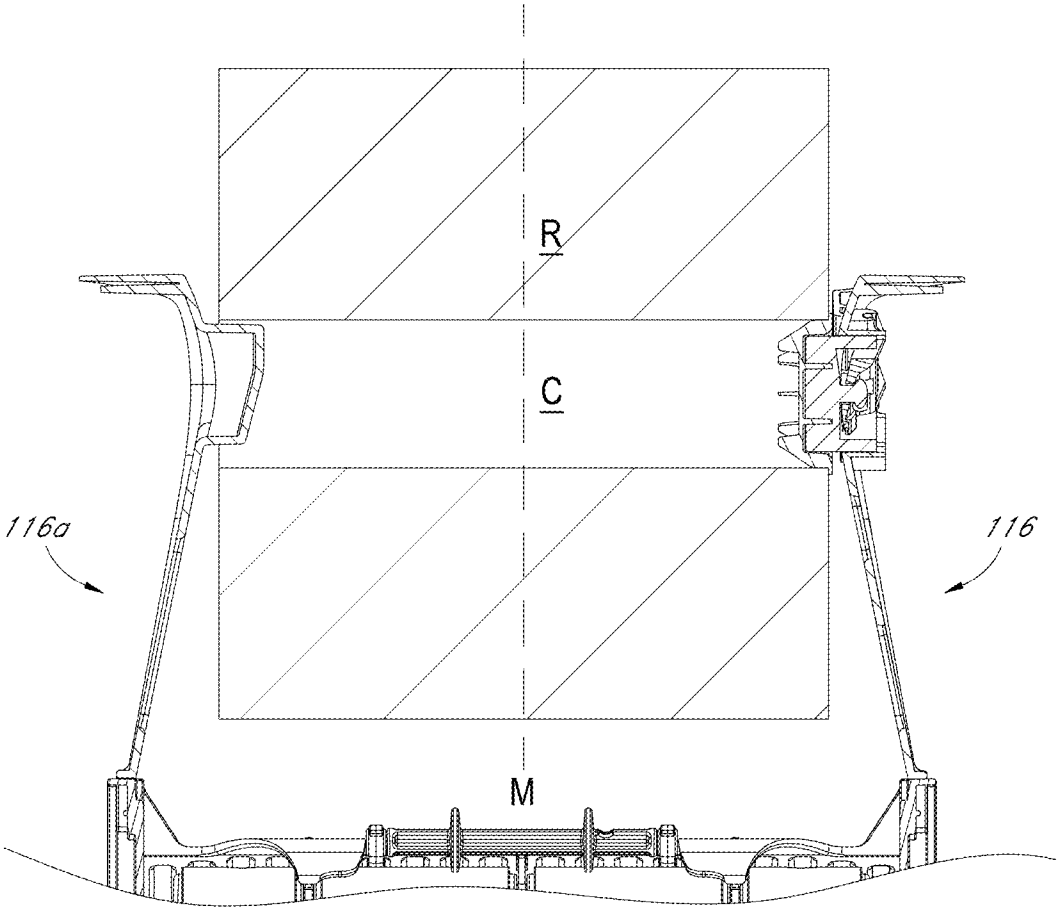
Figure 8C:
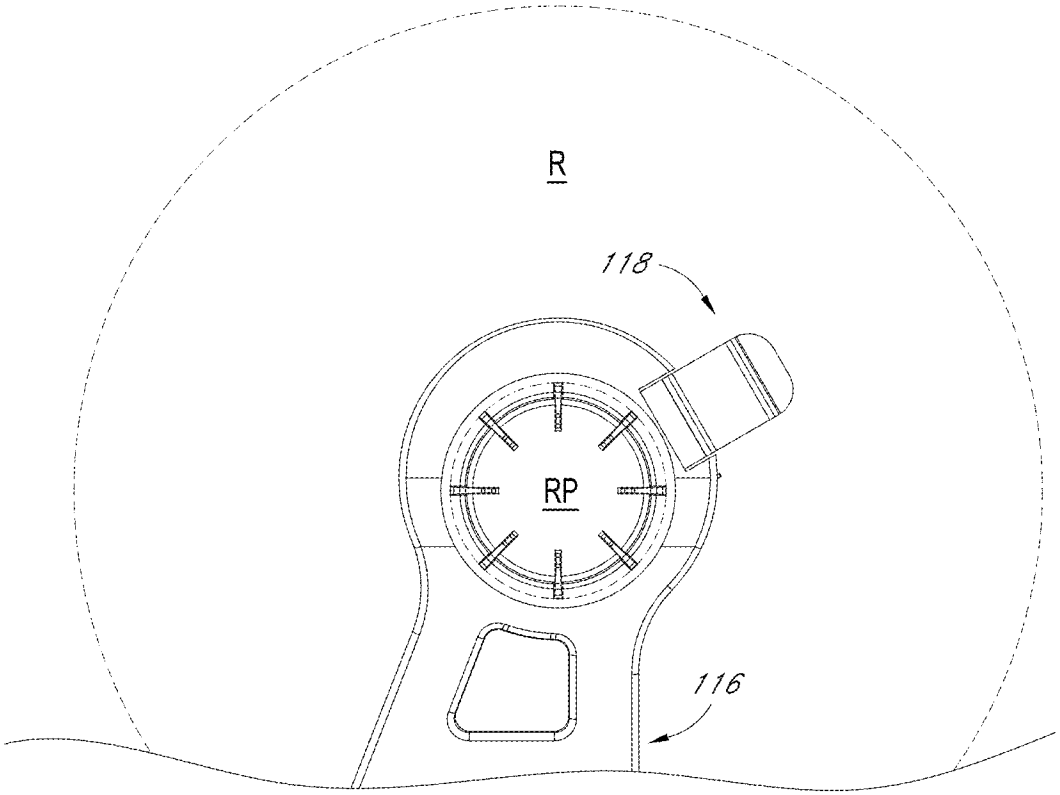
Figure 8D:
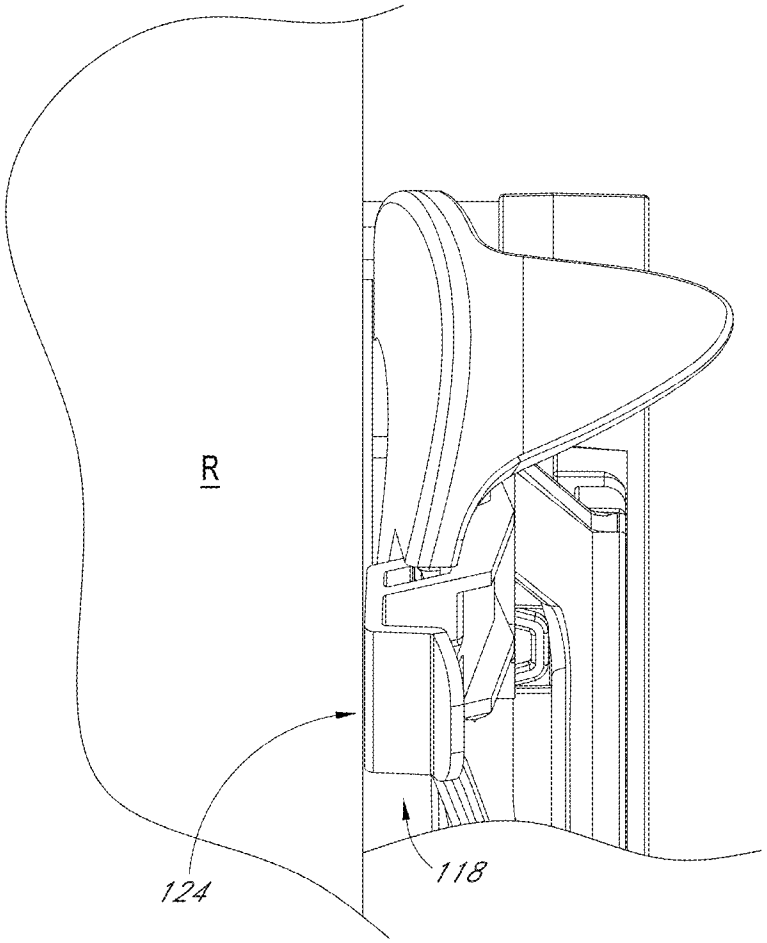
Figure 8E:
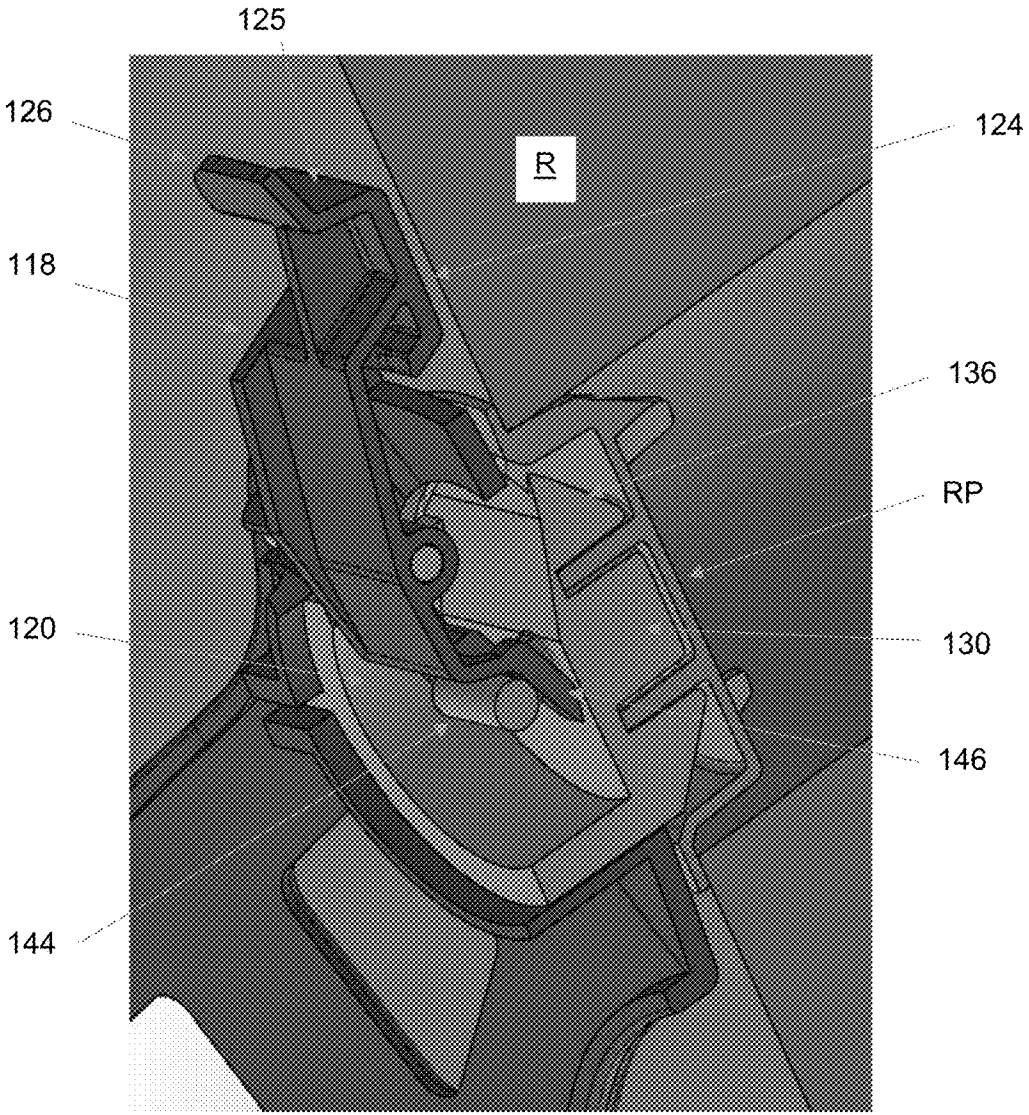
FIGS. 8E-8G illustrate cross-sectional views of a sensor and piston of the roll support.
Figure 8F:
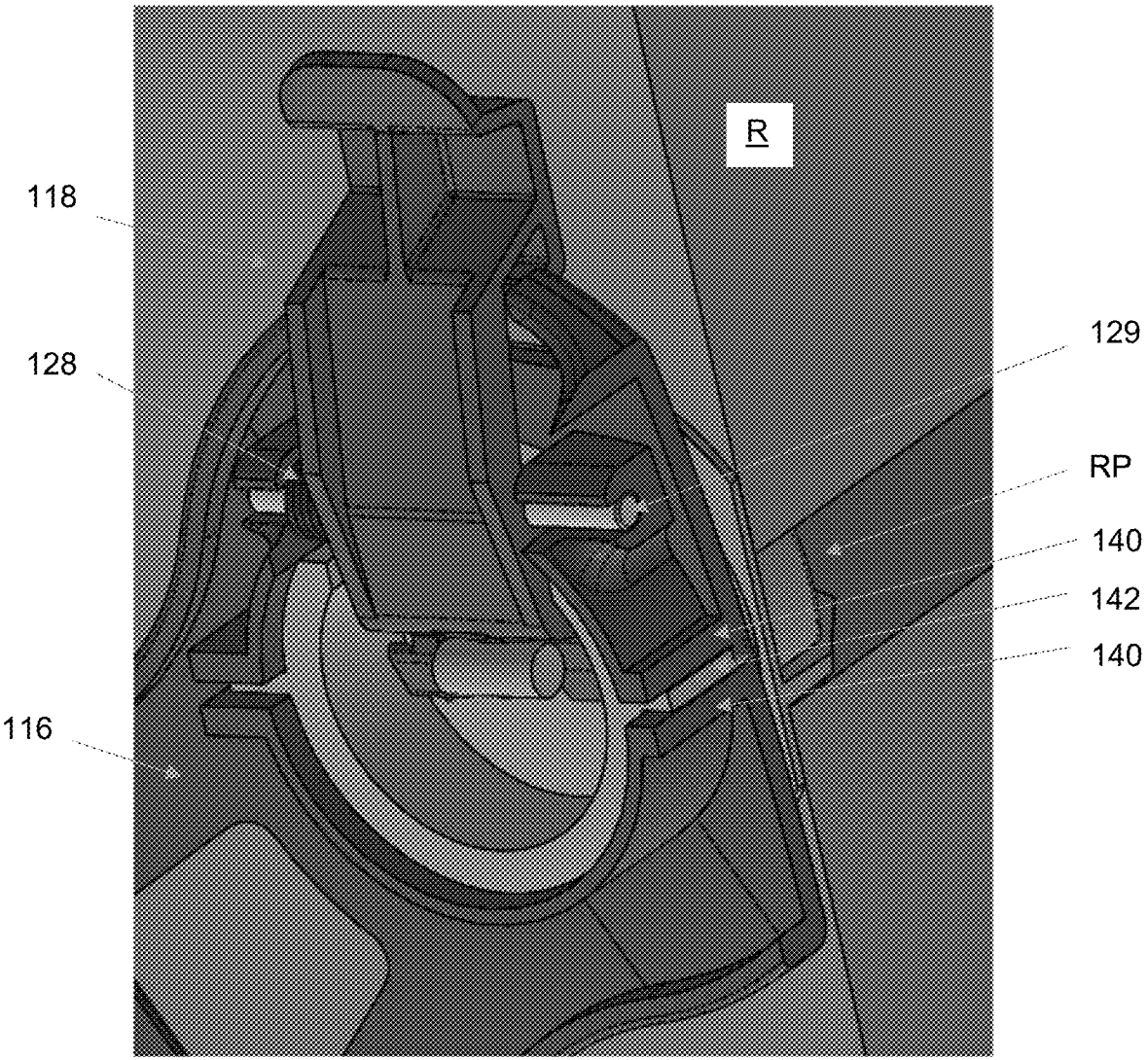
Figure 8G:
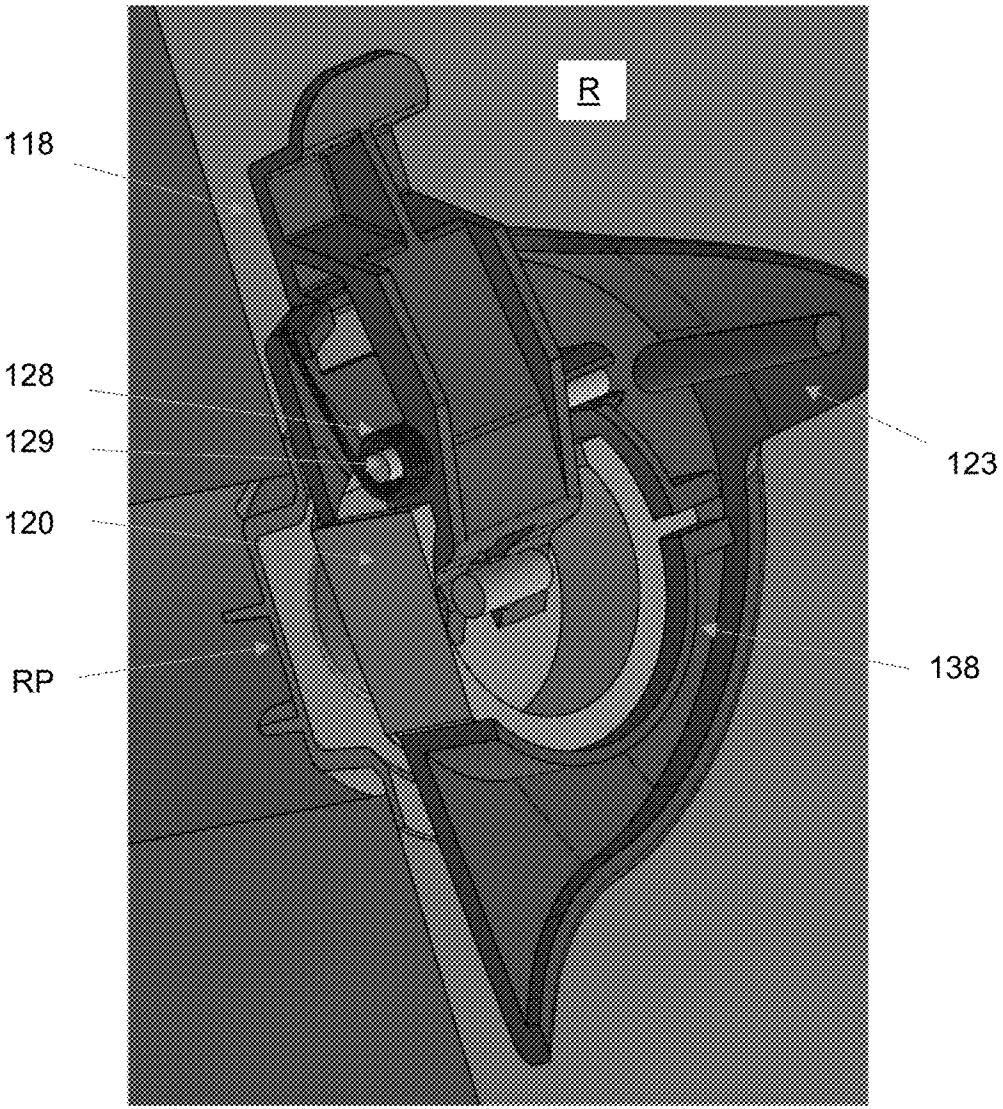
Figure 9B:
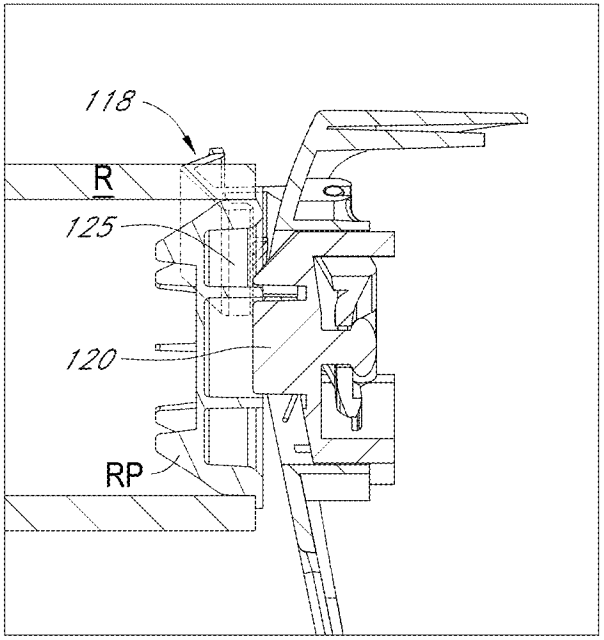
FIGS. 9A-9D illustrate front cross-sectional, close-up, side, and top views of portions of the dispenser system with the roll support almost disengaged with the tissue roll. For the side view of FIG. 9C, the roll is illustrated as transparent and in dashed lines for purposes of presentation.
Figure 9A:
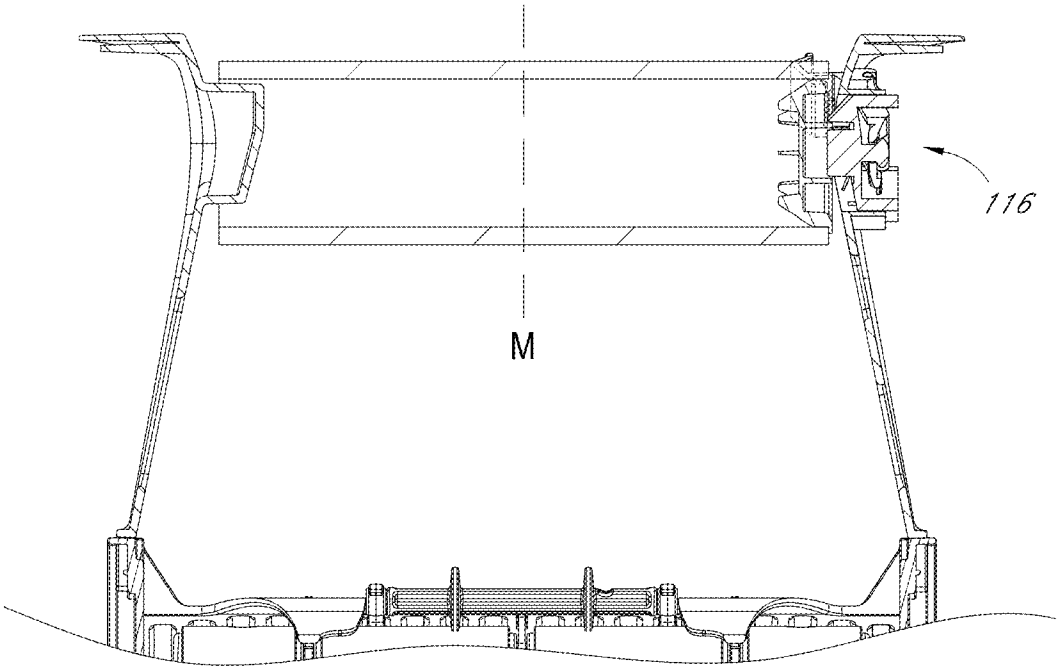
Figure 9C:
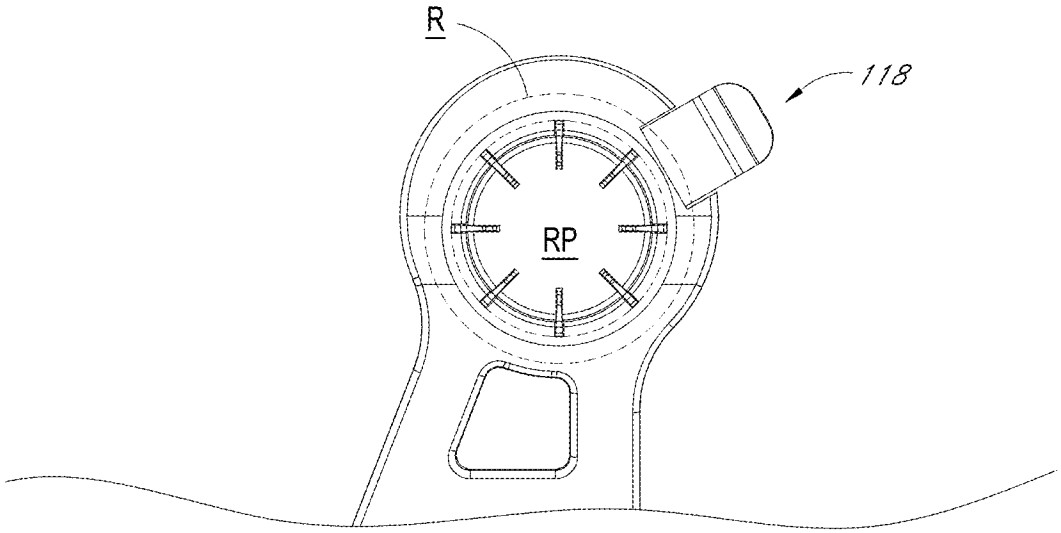
Figure 9D:
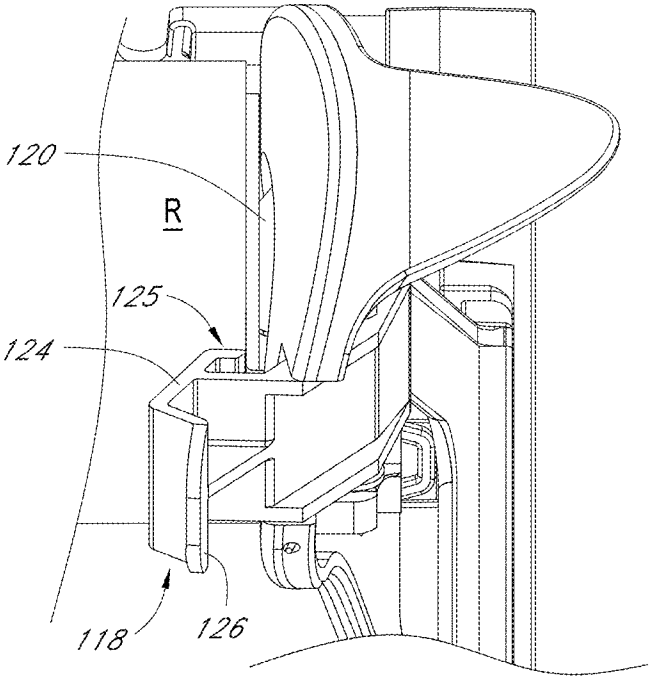
Figure 10B:
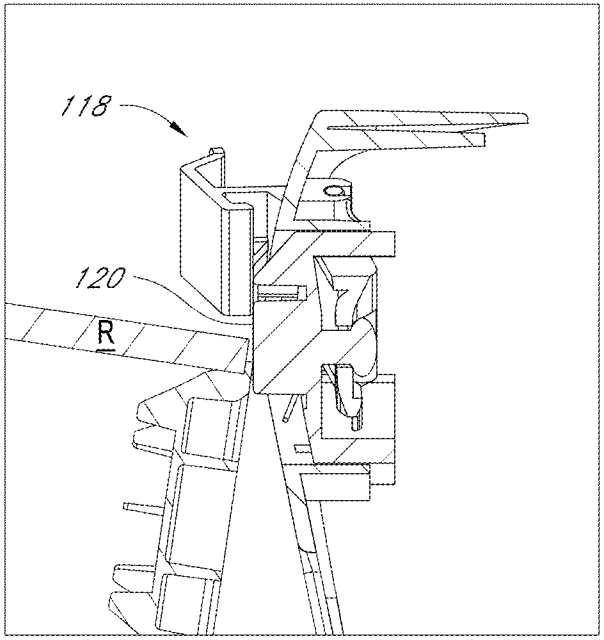
FIGS. 10A-10D illustrate front cross-sectional, close-up, side, and top views of portions of the dispenser system with the roll support disengaged with the tissue roll. For the side view of FIG. 10C, the roll is illustrated as transparent and in dashed lines for purposes of presentation.
Figure 10A:
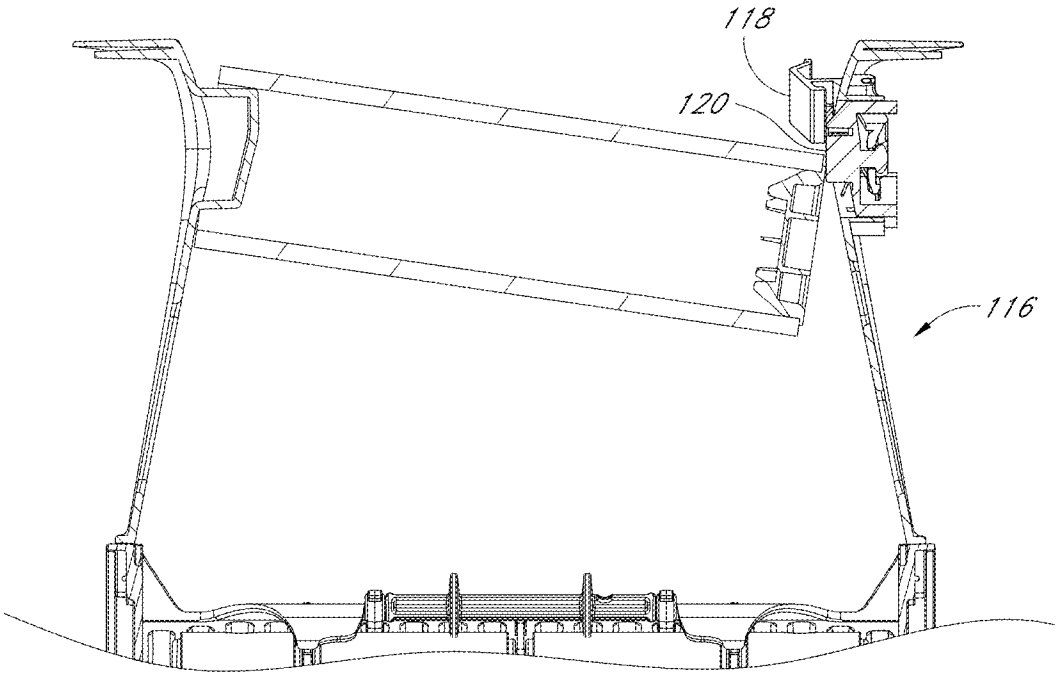
Figure 10C:
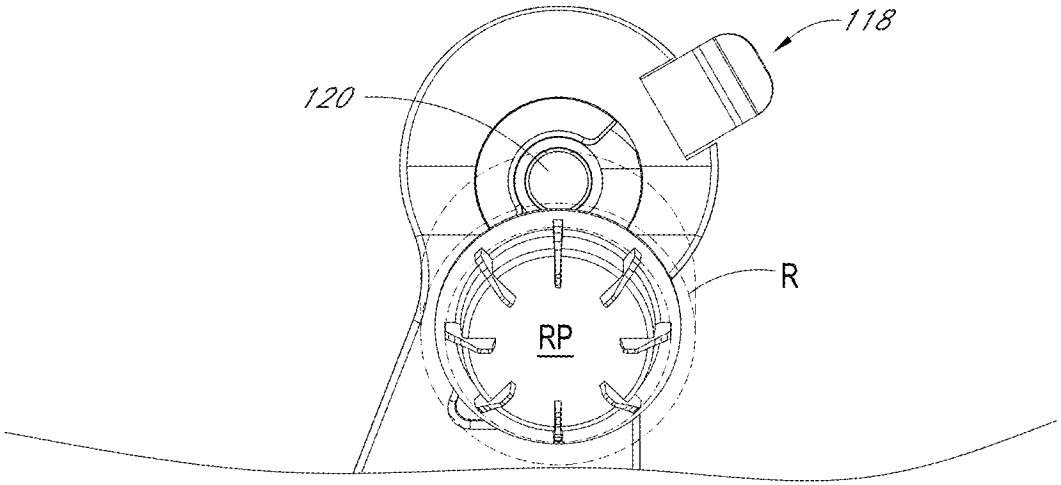
Figure 10D:
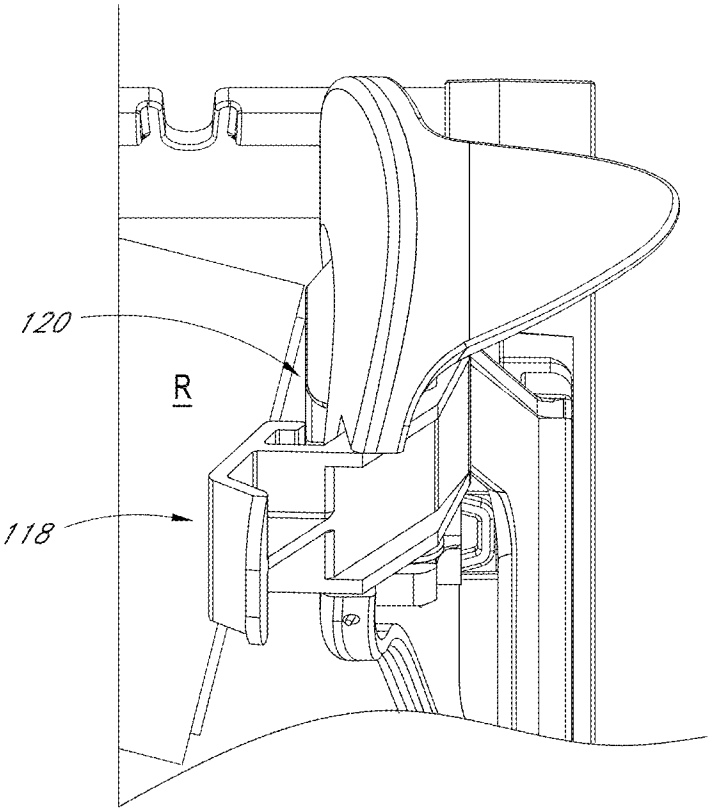

FIGS. 8A-8D illustrates views of portions of the dispenser system 110 with the roll support 116 engaged with a fresh roll R, such as a full roll of paper towels. FIGS. 8E-8G illustrate cross-sectional views of the sensor 118 and piston 120 of the roll support 116. In the embodiment shown, the roll support 116 is engaged with a roll plug RP in the hollow core C of the roll R. The first face 124 of the sensor 118 is abutted against the axial end of the roll R. The physical interference between the roll R and the sensor 118 pushes the sensor 118 against the bias of the biasing member 128. For example, the sensor 118 can be pushed outward and/or away from a midline M of the roll R. The sensor 118 in turn can drive the piston 120, such as toward the midline M. The piston 120 can be pushed into (e.g., be received in) the roll plug RP (or into the core for an embodiment that does not engage with a roll plug or against an axial end of the roll for an embodiment that does not engage with a roll plug or hollow core). This can provide a physical interference that inhibits or prevents the roll R from disconnecting from the roll support 116. In certain implementations, the first face 124 of the sensor 118 and/or the piston 120 apply a force to the roll R and/or the roll plug RP. The force can be generally parallel to the axis of rotation of the roll R and/or generally horizontally.

FIGS. 9A-9D illustrate views of portions of the dispenser system 110 when the roll R is close to, but not yet at, the threshold size. As shown, the sensor 118 has moved to remain engaged with the now smaller roll R. For example, the sensor 118 has extended inwardly and/or toward the midline M of the roll R. Relatedly, the piston 120 has moved oppositely, such as retracting outwardly into the frame and/or away from the midline M. The interference between the piston 120 and the roll plug RP has thus deceased, though in this state some interference remains.

As illustrated, the second face 125 of the sensor 118 is abutted against the roll R. Because the roll R continues to displace the sensor 116 against the bias of the biasing member 128, the sensor 116 continues to apply a force to the roll R. However, in some implementations, due to the configuration (e.g., angle) of the second face 125, the force is applied in a direction that is configured to push the roll R off the piston 120. For example, the force can be applied in a direction that is generally perpendicular to the axis of rotation of the roll R and/or generally vertically. In various embodiments, the sensor 116 transitions from pushing laterally on the end of the roll R to radially as the diameter of the roll R decreases. In some embodiments, the sensor 116 helps to push the roll R downward as the piston 120 retracts.

FIGS. 10A-10D illustrate views of portions of the dispenser system 110 with the roll support 116 having just dropped the roll R. When the roll R decreased to the threshold size, the piston 120 was retracted such that all or enough of the interference between the piston 120 and the roll plug RP was removed. Accordingly, the roll R was no longer supported by the roll support 116 and therefor the roll R automatically dropped, such as by force of gravity. The roll support 116 can thus receive a fresh roll. The dropped roll (now a stub roll) can fall from the main position to a secondary position. The secondary position can be in the front or rear of the casing 112. As mentioned above, in some embodiments, the dispensing system 114 can continue to dispense material from the stub roll and/or can switch to dispensing material from the fresh roll.

In various embodiments, the roll R is dropped before the piston completely retracts from the roll R and/or roll plug RP. For example, as mentioned above, in certain embodiments the sensor 118 applies a force to the roll R that tends to dislodge the roll from the roll support 116 as the roll decreases in size. This force can cause the roll to be dropped before the piston 120 has fully disengaged from (e.g., withdrawn out of) the roll R and/or roll plug RP.

Figure 11D:
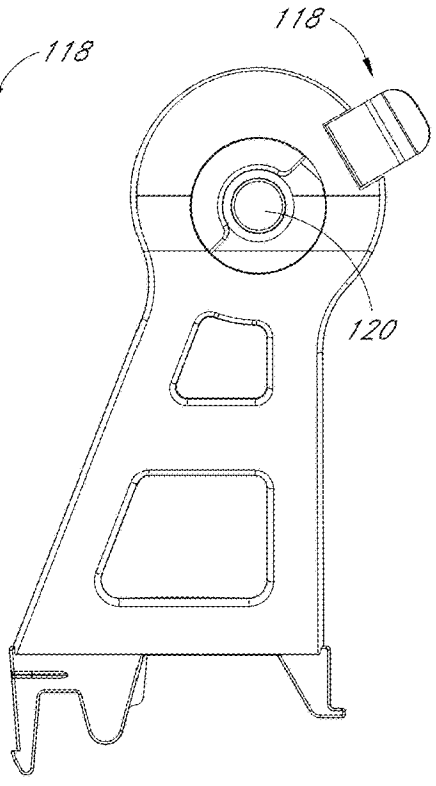
FIGS. 11A-11D illustrate back, front, isometric, and side views of the roll support in a state in which the roll support is not engaged with a tissue roll, such as before the roll support has been engaged with a tissue roll and/or after the roll support has disengaged from the roll.
Figure 11C:
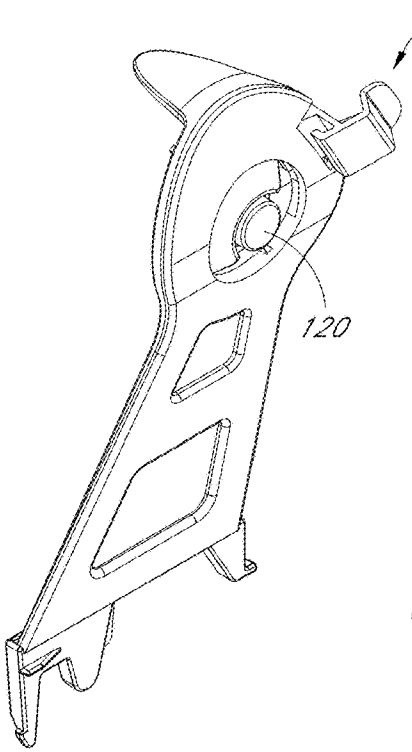
Figure 11B:
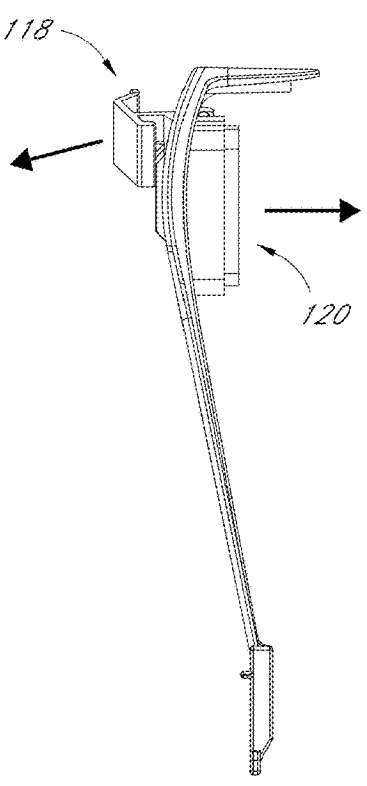
Figure 11A:
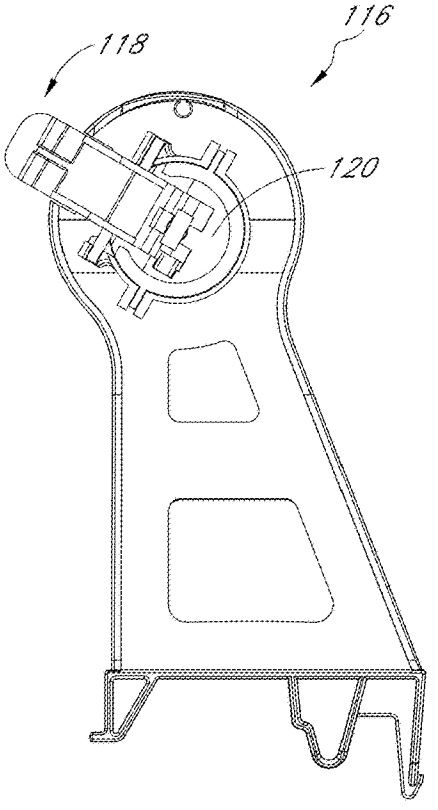
Figure 12D:
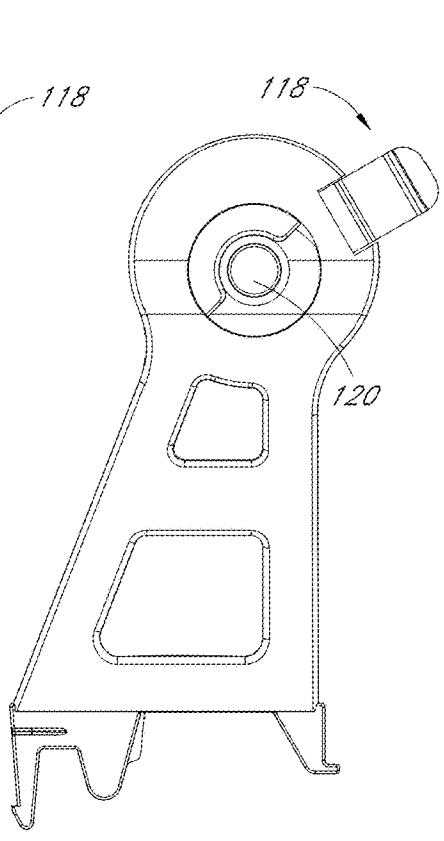
FIGS. 12A-12D illustrate back, front, isometric, and side views of the roll support in a state in which the roll support is engaged with a fresh tissue roll (not shown).
Figure 12C:
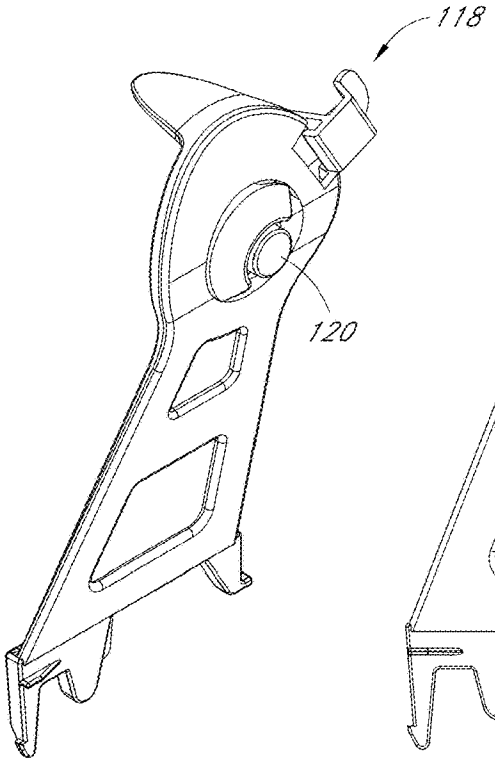
Figure 12B:
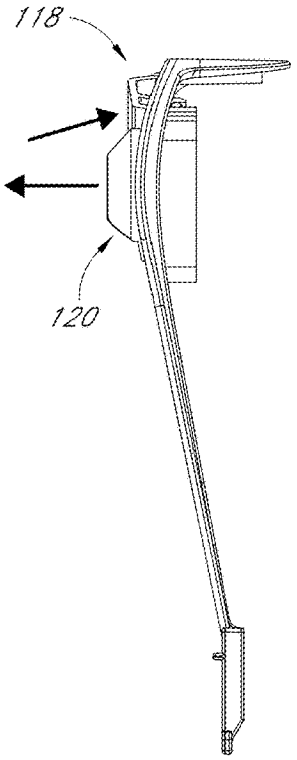
Figure 12A:
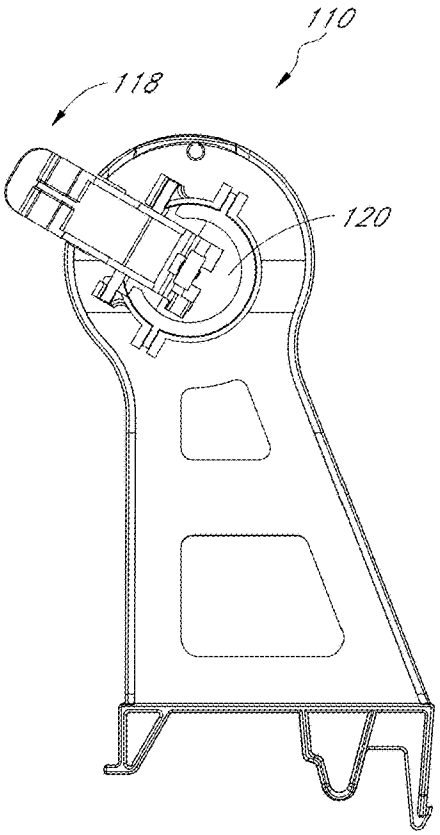

FIGS. 11A-11D illustrate views of the roll support 116 in a state in which the roll support 116 is not engaged with a tissue roll, such as before the roll support 116 has been engaged with the roll R and/or after the roll support 116 has disengaged from the roll R. As shown, the sensor 118 is fully extended and the piston 120 is fully retracted. As can be seen in FIG. 11C, when not engaged with a roll, some or all of the piston 120, such as the outer end of the hub 130, can be recessed within the frame and/or not protrude from a front side of the frame (which is the side that faces the roll when the roll is installed). In some implementations, in such a state, at least a portion of the piston, such as the outer end of the hub 130, is generally flush with a portion of the front side of the frame that surrounds the piston 120, is positioned laterally outward of the front side of the frame, and/or is recessed in the opening in the frame. The biasing member 128 can bias the sensor 118 and piston 120 to the configuration illustrated. The approximate directions of movement of the sensor 118 and piston 120 and/or of force applied by the biasing member 128 to the sensor 118 and piston 120 are shown by arrows in FIG. 11B.

Figure 13A:
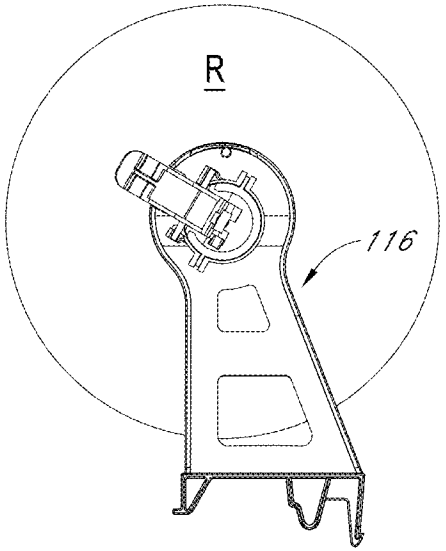
FIGS. 13A-13C illustrate back, front, and isometric views of the roll support in a state in which the roll support is engaged with a fresh tissue roll (shown).
Figure 13B:
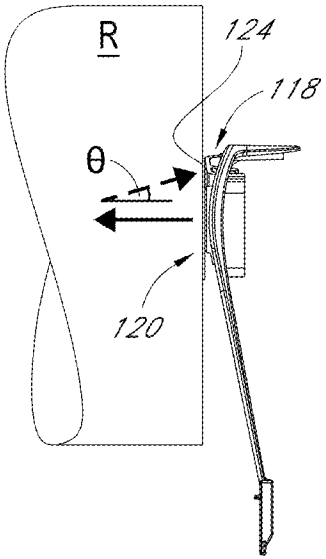
Figure 13C:
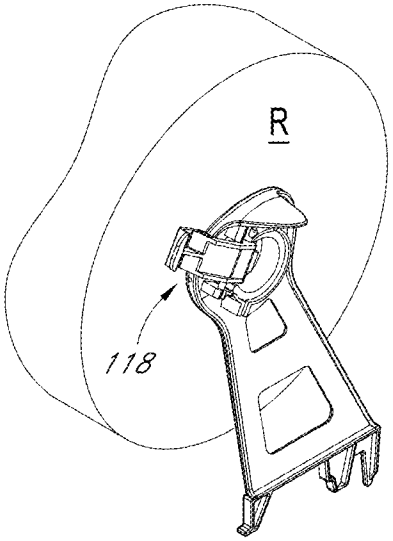

FIGS. 12A-12D and 13A-13C illustrate views of the roll support 116 in a state in which the roll support 116 is engaged with a fresh roll. The roll is shown in FIGS. 13A-13C but not in 12A-12D. Compared to FIGS. 11A-11D, the sensor 118 has been fully retracted and the piston 120 has been fully extended. This can be due to the roll pressing against the sensor 118, thereby displacing the sensor 118, which in turn displaces the piston 120. The approximate directions of movement of the sensor 118 and piston 120 are shown by arrows in FIG. 12B (the sensor arrow in dashed line, the piston arrow in solid line). In some embodiments, the sensor 118 applies a force in a direction opposite to the direction of movement. The sensor 118 can apply a force to the roll R at an angle θ, which can be measured relative to a line parallel to the axis of rotation. In some embodiments, the angle θ is less than or equal to about: −10°, −5°, 0°, 5°, 10°, 20°, 30°, or otherwise. The piston 120 is engaged into the roll and provides support for the roll R.

Figure 14C:
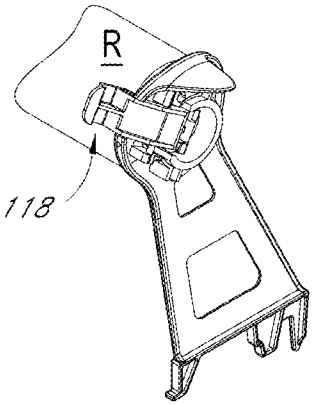
FIGS. 14A-14C illustrate back, front, and isometric views of the roll support in a state in which the roll support is engaged with a roll that is approaching a threshold size.
Figure 14B:
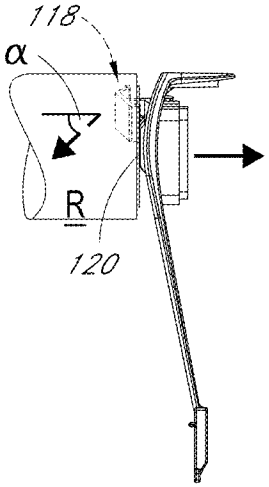
Figure 14A:
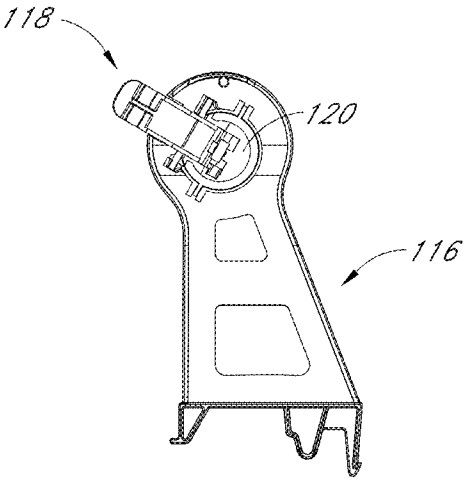

FIGS. 14A-14C illustrate views of the roll support 116 in a state in which the roll support 116 is engaged with a roll that is approaching a threshold size. Again, the approximate directions of movement of the sensor 118 and piston 120 are shown by arrows in FIG. 12B (the sensor arrow in dashed line, the piston arrow in solid line). In some embodiments, the sensor 118 applies a force in a direction opposite to the direction of movement. The sensor 118 can apply a force to the roll R at an angle α, which can be measured relative to a line parallel to the axis of rotation. The angle α can be greater than the angle θ. In some embodiments, the angle α is greater than or equal to about: 30°, 45°, 60°, 70°, 80°, 90°, 100°, or otherwise. The angle α can change (e.g., increase) as the roll R is expended, such as in direct relation. The sensor 118 can apply force to the roll R, wherein the force has a decreasing axial component and/or an increasingly radial component. The components can change as the size of the roll changes, such as proportionally (e.g., linearly). The radial component can be in a direction that tends to dislodge component the roll R from the piston 120. For example, in a direction that is downward and/or perpendicular to the axis of rotation. In the state illustrated, compared to FIGS. 12A-12D and 13A-13C, the sensor 118 has extended and the sensor 120 has retracted partially out of engagement with the roll. Thus, the roll support's 116 support with the roll has decreased.

With continued dispensation of the material from the roll, the roll will reach the threshold size. When that occurs, the piston 120 will be sufficiently retracted from the roll, and/or the sensor 118 will apply enough force to the roll, that the roll will be dislodged from the roll support 116. The dislodged roll can fall into a stub roll compartment. After dislodging of the roll, the roll support 116 automatically returns to the state shown in FIGS. 11A-11D and is ready for the installation of another roll.

The present disclosure includes methods related to operating a dispenser system. In some embodiments, the method can include receiving a roll in a roll support. The method can include displacing a sensor with the roll, such as by displacing the sensor to a retracted position and/or acting against the bias of a spring. The method can include inserting a piston into the roll, such as to provide a physical interference that supports at least one end of the roll from dropping downward. The method can include detecting a decrease in the size of the roll, such as an outside diameter. The detecting can be performed by extending the sensor and/or by maintaining the sensor in engagement with the roll. The method can include retracting the piston, such as in response to and/or in proportion to the detected decrease in the size of the roll. The method can include reducing or removing a physical interference provided by the piston. The method can include dropping the roll from the roll support, such as at least partially by force of gravity. The method can include pushing the roll with the sensor, such as in a direction that tends to dislodge the roll from the roll support.

4. Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees and the term "generally perpendicular" can refer to something that departs from exactly perpendicular by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

5. Summary

The technology of the present disclosure has been discussed in the context of certain embodiments and examples. The technology extends beyond the specifically disclosed embodiments to other alternative embodiments and/or uses of the embodiments and certain modifications and equivalents thereof. For example, although certain embodiments are disclosed in the context of a manually-operated tissue dispenser, the technology can be applied to motorized dispensers too. Any two or more of the components of the dispenser system can be made from a single monolithic piece or from separate pieces connected together. Various features and aspects of the disclosed embodiments can be combined with or substituted for one another in order to form varying modes of the invention. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying drawings. The figures are drawn to scale, but such scale is not limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of dispensing systems and related methods have been disclosed. Although the dispensing systems have been disclosed in the context of those embodiments and examples, the technology of this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

The following is claimed:

1. A dispensing system that is configured to dispense tissue from a roll, the dispensing system comprising:

a casing;

a dispensing mechanism in the casing;

a roll support in the casing and configured to support an end of the roll, the roll support comprising:

a sensor configured to engage an outside of the roll, the sensor configured to extend in response to a decrease in a size of the roll;

a biasing member that biases the sensor such that the sensor applies a force against the outside of the roll; and a piston configured to be received inside a hollow core or a roll plug of the roll, the piston operably connected with the sensor such that the piston progressively retracts out of the hollow core or roll plug as the sensor extends;

the roll support configured such that, when the roll reaches a threshold size, the roll automatically drops off the roll support at least partially by force of gravity.

2. The dispensing system of claim 1, wherein the roll support is mounted to the casing or the dispensing mechanism.

3. The dispensing system of claim 1, wherein the sensor is configured to pivot about a fulcrum.

4. The dispensing system of claim 1, wherein the sensor comprises a first face and a second face, the sensor configured such that the first face engages the outside of the roll when the roll is substantially full and the second face engages the outside of the roll when the roll is substantially empty but has not yet reached the threshold size.

5. The dispensing system of claim 4, wherein the roll support is further configured such that:

when the first face is engaged with the outside of the roll, the sensor applies a force to the roll in a direction that is generally parallel to an axis of rotation of the roll; and when the second face is engaged with the outside of the roll, the sensor applies a force to the roll in a direction that is generally perpendicular to the axis of rotation of the roll.

6. The dispensing system of claim 1, wherein the threshold size comprises an outside diameter.

7. The dispensing system of claim 1, wherein the piston comprises a hub configured to slide in a direction that is generally parallel to an axis of rotation of the roll.

8. The dispensing system of claim 1, wherein the operative connection between the sensor and piston transmits pivoting motion of the sensor into translational motion of the piston.

9. The dispensing system of claim 1, wherein the amount of movement of the sensor and piston are linearly related.

10. The dispensing system of claim 1, wherein the tissue comprises paper towels, paper napkins, or toilet tissue.

11. The dispensing system of claim 1, wherein the dispensing mechanism comprises a transfer module configured to dispense tissue from the roll after the roll has dropped off the roll support.

12. The dispensing system of claim 1, wherein the threshold size is an outside diameter of less than or equal to about 3.5 inches.

13. A dispensing system that is configured to dispense tissue from a roll, the dispensing system comprising:

a casing;

a dispensing mechanism in the casing;

a first roll support and a second roll support, the first and second roll supports configured to support the roll within the casing and to allow the roll to rotate about an axis of rotation, the first roll support comprising:

a frame;

a sensor connected to the frame and configured to detect a size of the roll, the sensor being movable between a retracted position and an extended position, the sensor biased toward the extended position; and a piston connected to the frame, the piston being movable between a protruding state and a withdrawn state, wherein in the protruding state the piston is received inside a hollow core or a roll plug of the roll and in the withdrawn state the piston is substantially or completely withdrawn from the hollow core or the roll plug;

the piston and sensor being operably connected such that, as the sensor moves from the retracted position to the extended position, the piston moves from the protruding state to the withdrawn state.

14. The dispensing system of claim 13, wherein the sensor is configured to detect the size of the roll by abutting against the roll.

15. The dispensing system of claim 13, wherein the sensor is pivotable between the retracted position and the extended position and the piston is slidable between the protruding position and the withdrawn position.

16. The dispensing system of claim 13, wherein the sensor comprises a first face and a second face, the first face configured to engage against the roll when the sensor is in the retracted position, the second face configured to engage against the roll when the sensor is in the extended position.

17. The dispensing system of claim 16, wherein the roll support is further configured such that:

when the first face is engaged with the roll, the sensor applies a force to the roll in a direction that is generally parallel to the axis of rotation of the roll; and when the second face is engaged with the roll, the sensor applies a force to the roll in a direction that is generally perpendicular to the axis of rotation of the roll.

18. A dispensing system that is configured to dispense tissue from a roll, the size of the roll progressively decreasing as the roll is dispensed, the dispensing system comprising:

a casing;

a dispensing mechanism in the casing;

a first roll support and a second roll support, the first and second roll supports configured to support the roll within the casing and to allow the roll to rotate about an axis of rotation;

the first roll support comprising a sensor that is configured to apply a force to an outside of the roll and a piston that is receivable within the roll;

the first roll support configured such that, as the size of the roll decreases:

the sensor transitions from applying the force to an axial end of the roll to an outside diameter of the roll; and the piston withdraws at least partly from inside the roll.

19. The dispensing system of claim 18, wherein the first roll support is further configured such that, as the size of the roll decreases to a threshold amount, the force applied by the sensor dislodges the roll from the first roll support.

20. The dispensing system of claim 18, wherein the sensor comprises a pivotable lever and the piston comprises a slidable hub.

* * * * *